US005746635A

United States Patent [19]

Spindt et al.

[11] Patent Number: 5,746,635

[45] Date of Patent: May 5, 1998

[54] METHODS FOR FABRICATING A FLAT PANEL DISPLAY HAVING HIGH VOLTAGE SUPPORTS

[75] Inventors: Christopher J. Spindt, Menlo Park; David L. Morris; Theodore S. Fahlen, both of San Jose; Anthony P. Schmid, Solana Beach; Paul A. Lovoi, Saratoga, all of Calif.

[73] Assignee: Candescent Technologies Corporation, San Jose, Calif.

[21] Appl. No.: 572,348

[22] Filed: Dec. 12, 1995

Related U.S. Application Data

[60] Continuation of Ser. No. 450,327, May 25, 1995, abandoned, which is a division of Ser. No. 188,857, Jan. 31, 1994, abandoned, which is a continuation-in-part of Ser. No. 12,542, Feb. 1, 1993, Pat. No. 5,589,731, which is a continuation-in-part of Ser. No. 867,044, Apr. 10, 1992, Pat. No. 5,424,605.

[51] Int. Cl.[6] ..... H01J 9/20

[52] U.S. Cl. ..... 445/24; 445/58

[58] Field of Search ..... 445/24, 25, 58

[56] References Cited

U.S. PATENT DOCUMENTS

| | | | |
|---|---|---|---|
| 3,755,704 | 8/1973 | Spindt et al. . | |
| 3,935,499 | 1/1976 | Oess . | |
| 4,021,219 | 5/1977 | Stockdale et al. . | |
| 4,088,920 | 5/1978 | Siekanowicz et al. . | |
| 4,174,523 | 11/1979 | Marlowe et al. . | |
| 4,204,302 | 5/1980 | Bing et al. | 445/31 |
| 4,227,117 | 10/1980 | Watanabe et al. . | |
| 4,577,133 | 3/1986 | Wilson . | |
| 4,622,492 | 11/1986 | Barten . | |
| 4,757,230 | 7/1988 | Washington et al. . | |
| 4,857,799 | 8/1989 | Spindt et al. . | |
| 4,887,000 | 12/1989 | Yamazaki et al. . | |
| 4,900,981 | 2/1990 | Yamazaki et al. . | |
| 4,923,421 | 5/1990 | Brodie et al. . | |

(List continued on next page.)

FOREIGN PATENT DOCUMENTS

| | | |
|---|---|---|
| 0 405 262 | 1/1991 | European Pat. Off. . |
| 0 436 997A1 | 7/1991 | European Pat. Off. . |
| 0 464 938A1 | 1/1992 | European Pat. Off. . |
| 0 496 450A1 | 7/1992 | European Pat. Off. . |
| 0 523 702A1 | 1/1993 | European Pat. Off. . |
| 0 580 244A1 | 1/1994 | European Pat. Off. . |
| 61-224256 | 10/1986 | Japan . |

OTHER PUBLICATIONS

Andreadakis et al., "Influence of Barrier Ribs on the Memory Margin of ac Plasma Display Panels", *Proceedings of the SID*, vol. 31/4, 1990, pp. 355–360.

Brodie et al., "Vacuum Microelectronics", *Advances in Electronics and Electron Physics*, vol. 83, 1992, pp. 1–106.

Goede, Digital Address Thin Display Tube, Northrop Corp./NTIS, Nov. 1974, pp. 1–134.

(List continued on next page.)

*Primary Examiner*—Kenneth J. Ramsey

*Attorney, Agent, or Firm*—Skjerven, Morrill, MacPherson, Franklin & Friel; Alan H. MacPherson; E. Eric Hoffman

[57] ABSTRACT

According to the invention, a flat panel device includes a spacer for providing internal support. In one embodiment, the spacer is made of ceramic, glass-ceramic, ceramic reinforced glass, devitrified glass, metal with electrically insulative coating or high-temperature vacuum-compatible polyimide, and can be a spacer wall, a spacer structure including a plurality of holes, or some combination of a spacer wall, spacer walls, and spacer structure. Spacer surfaces are treated to reduce secondary emissions and prevent charging of the spacer surfaces. The flat panel device can include a thermionic cathode or a field emitter cathode, and the faceplate and backplate can both be straight or both be curved. The flat panel device can include an addressing grid. In a method according to the invention for assembling a flat panel device, spacer walls are held in proper alignment during assembly by being inserted into a notch formed in the addressing grid and/or a top or bottom wall of the enclosure. Spacers according to the invention can be easily fabricated using standard techniques for forming and assembling ceramic or glass-ceramic tape.

40 Claims, 14 Drawing Sheets

U.S. PATENT DOCUMENTS

| | | |
|---|---|---|
| 4,924,148 | 5/1990 | Schwartz . |
| 5,003,219 | 3/1991 | Muragishi et al. . |
| 5,053,673 | 10/1991 | Tomii et al. . |
| 5,063,327 | 11/1991 | Brodie et al. . |
| 5,083,058 | 1/1992 | Nonomura et al. . |
| 5,155,410 | 10/1992 | Wakasano et al. . |
| 5,160,871 | 11/1992 | Tomii et al. . |
| 5,227,691 | 7/1993 | Murai et al. . |
| 5,229,691 | 7/1993 | Shichao et al. . |
| 5,313,136 | 5/1994 | Van Gorkom et al. . |

OTHER PUBLICATIONS

Goede, "A Digitally Addressed Flat-Panel CRT", *IEEE Transactions on Electron Devices,* vol. ED-20, No. 11, Nov. 1973, pp. 1052–1061.

Jaitly et al., "In-situ Insulator Surface Charge Measurements in Dielectric Bridged Vacuum Gaps Using an Electrostatic Probe", *IEEE Transactions on Electrical Insulation,* vol. 23, No. 2, Apr. 1988, pp. 261–273.

Meyer, "6 Diagonal Microtips Flourescent Display for T.V. Applications", *EuroDisplay Digest,* Sep. 1990, (4 pages).

Meyer "Recent Development on 'Microtips' Display at Leti", *Technical Digest of IVMC 91,* 1991, pp. 6–9.

Takahashi et al., "Back Modulation Type Flat CRT", Japan Display '92, 1992, pp. 377–380.

Tannas, Jr. et al., *Flat-Panel Displays and CRTs,* 1985, pp. 218–219, 231–232, 360, 400, 403.

Uchiike et al., "Reflective Phosphor Deposition on the Barrier Electrode Structure of an ac Plasma Display Results in High Brightness and High Luminous Efficiency", *SID 92 Digest,* Late-News Paper 28:6, 1992, pp. 543–546.

Patent Abstracts of Japan, vol. 008, No. 047 (M-280), 2 Mar. 1984 & JP.A. 58 202711 (Mitsubishi Kinzoku KK), 26 Nov. 1983.

METHODS FOR FABRICATING A FLAT PANEL DISPLAY HAVING HIGH VOLTAGE SUPPORTS

CROSS-REFERENCE TO RELATED APPLICATIONS

This is a continuation of U.S. patent application Ser. No. 08/450,327, filed May 25, 1995, now abandoned, which is a division of U.S. patent application Ser. No. 08/188,857, filed Jan. 31, 1994, which is a continuation-in-part of U.S. patent application Ser. No. 08/012,542, filed Feb. 1, 1993, which is a continuation-in-part of U.S. patent application Ser. No. 07/867,044, filed Apr. 10, 1992, now U.S. Pat. No. 5,424,605. To the extent not repeated herein, the contents of U.S. Ser. Nos. 08/012,542 and 07/867,044 are incorporated by reference.

BACKGROUND OF THE INVENTION

1. Field of the Invention

This invention relates to flat panel devices such as a flat cathode ray tube (CRT) display. More particularly, this invention relates to a support structure for internally supporting a faceplate and backplate of a flat panel device and, most particularly, to such a support structure that resists electrostatic charging.

2. Related Art

Numerous attempts have been made in recent years to construct a flat CRT display (also known as a "flat panel display") to replace the conventional deflected-beam CRT display in order to provide a lighter and less bulky display. In addition to flat CRT displays, other flat panel displays, such as plasma displays, have also been developed.

In flat panel displays, a faceplate, a backplate, and connecting walls around the periphery of the faceplate and backplate form an enclosure. In some flat panel displays, the enclosure is held at vacuum pressure, e.g., in flat CRT displays, approximately $1\times10^{-7}$ torr. The interior surface of the faceplate is coated with light emissive elements such as phosphor or phosphor patterns which define the active region of the display. The light emissive elements are caused to emit light, e.g., cathodic elements located adjacent the backplate are excited to release electrons which are accelerated toward the phosphor on the faceplate, causing the phosphor to emit light which is seen by a viewer at the exterior surface of the faceplate (the "viewing surface").

In vacuum pressure flat panel displays, a force is exerted on the walls of the flat panel display due to the differential pressure between the internal vacuum pressure and the external atmospheric pressure that, left unopposed, can make the flat panel display collapse. In rectangular displays having greater than an approximately 1 inch diagonal (the diagonal is the distance between opposite corners of the active region), the faceplate and backplate are particularly susceptible to this type of mechanical failure due to their high aspect ratio. Here, "aspect ratio" is defined as either the width, i.e., distance between the interior surfaces of opposing connecting walls, or the height, i.e., distance between the interior surface of the faceplate and the interior surface of the backplate, divided by the thickness. The faceplate or backplate of a flat panel display may also fail due to external forces resulting from impacts sustained by the flat panel display.

Spacers have been used to internally support the faceplate and/or backplate. Previous spacers have been walls or posts located between pixels (phosphor regions that define the smallest individual picture element of the display) in the active region of the display.

Spacers have been formed by photopatterning polyimide. However, polyimide spacers have been found inadequate because of: 1) insufficient strength; 2) inability to match the coefficient of thermal expansion with the materials typically used for the faceplate (e.g., glass), backplate (e.g., glass, ceramic, glass-ceramic or metal) and addressing grid (e.g., glass-ceramic or ceramic), resulting in registration problems; and 3) outgassing that may occur when polyimide is used in a vacuum pressure environment.

Spacers have also been made of glass. However, glass may not have adequate strength. Further, micro-cracks that are inherent in glass make glass spacers even weaker than "ideal" glass because of the tendency of micro-cracks to propagate easily throughout glass.

Additionally, for any spacer material, the presence of the spacers may adversely affect the flow of electrons toward the faceplate in the vicinity of the spacer. For example, stray electrons may electrostatically charge the surface of the spacer, changing the voltage distribution near the spacer from the desired distribution and resulting in distortion of the electron flow, thereby causing distortions in the image produced by the display.

SUMMARY OF THE INVENTION

According to the invention, a flat panel device includes a spacer for providing internal support of the device. In particular, for devices which operate with an internal vacuum pressure, the spacer prevents the device from collapsing as a result of stresses arising from the differential pressure between the internal vacuum pressure (i.e., any pressure less than atmospheric pressure) and the external atmospheric pressure. The spacer also internally supports the device against stresses arising from external impact forces. Additionally, surfaces of the spacer within the enclosure are treated to prevent or minimize charge buildup on the spacer surfaces. Consequently, the presence of the spacer does not adversely affect the flow of electrons near the spacer, so that the image produced by the device is not distorted.

In one embodiment of the invention, a coating is formed on spacer surfaces, the coating being a material having a secondary emission ratio $\delta$ less than 4 and a sheet resistance between $10^9$ and $10^{14}$ ohms/□. In an additional embodiment the coating has a secondary emission ratio $\delta$ less than 2. The coating is selected from a group of materials including chromium oxide, copper oxide, carbon, titanium oxide or vanadium oxide. In one particular embodiment, the coating is chromium oxide.

In another embodiment of the invention, a first coating is formed on spacer surfaces. A second coating is formed over the first coating. The first coating is a material having a sheet resistance between $10^9$ and $10^{14}$ ohms/□. The second coating is a material having a secondary emission ratio $\delta$ less than 4. In an additional embodiment the second coating has a secondary emission ratio $\delta$ less than 2.

In yet another embodiment of the invention, spacer surfaces are first surface-doped to produce a sheet resistance between $10^9$ and $10^{14}$ ohms/□, then a coating is formed over the doped spacer surfaces, the coating being a material having a secondary emission ratio $\delta$ of less than 4. In an additional embodiment the coating has a secondary emission ratio $\delta$ less than 2. The coating is selected from a group of materials including chromium oxide, copper oxide, carbon, titanium oxide or vanadium oxide. In one particular embodiment, the coating is chromium oxide.

In still another embodiment, spacer surfaces are surface-doped to produce a sheet resistance between $10^9$ and $10^{14}$ ohms/□.

In each of the above embodiments including a coating or coatings, the total thickness of the coating or coatings is between 0.05 and 20 μm. In the embodiment including two coatings, the coating having a secondary emission ratio δ less than 4 is preferably formed with a thickness between 0.01 and 0.05 μm. Preferably, the coating or coatings are formed such that the sheet resistance varies no more than ±2% throughout the coating. In each of the embodiments in which spacer surfaces are surface-doped, the dopant can be, for instance, titanium, iron, manganese or chromium.

The spacer can be made of, for instance, ceramic and can be a spacer wall, a spacer structure, or some combination of a spacer wall, spacer walls, and spacer structure. The flat panel device also includes a means to emit light. The flat panel device can include either a field emitter cathode or a thermionic cathode. In alternative embodiments, the faceplate and backplate of the flat panel device can both be straight or both be curved. In a further embodiment of the invention, the flat panel device can include an addressing grid.

In an additional embodiment of the invention, one or more electrodes are formed on the treated spacer surfaces. For instance, an electrode can be formed near an interface of the spacer and backplate, the voltage of the electrode being controlled to achieve a desired voltage distribution in the vicinity of the interface, thereby deflecting the flow of electrons as desired to correct for distortions resulting from imperfections in the surface treatment or misalignment of the spacer. In a further embodiment, this electrode can be formed with a serpentine path with respect to an interior surface of the backplate in order to achieve a desired voltage distribution.

A voltage divider establishes the voltage of each electrode. In one embodiment, the voltage divider is a resistive coating formed on the spacer surfaces. The sheet resistance of the coating must be closely controlled (preferably ±2%) to achieve accurate voltages on the electrodes. In another embodiment, the voltage divider can be a resistive strip that is positioned outside the enclosure across the electrically conductive traces that extend from each of the electrodes. The voltage control of the voltage divider can be fine-tuned by "trimming," i.e., selectively removing material from the voltage divider to vary local resistance to establish the desired voltages on the electrodes.

In a further embodiment of the invention, a strip of electrically conductive material ("edge metallization") is formed between an edge surface of the spacer and the backplate, and in intimate contact with the entire length of the spacer. If a resistive coating is formed on the spacer surfaces, the edge metallization is electrically connected to the resistive coating. In that case, the edge metallization and the resistive coating are formed such that an interface between the edge metallization and the resistive coating is at a constant distance from an interior surface of the backplate. In like manner, edge metallization is formed between an edge surface of the spacer and the faceplate to establish good electrical connection between the faceplate and spacer.

In a method according to the invention, a flat panel device is assembled by mounting a spacer between a backplate and faceplate, treating surfaces of the spacer to prevent or minimize charge buildup on the spacer surfaces, coating an edge surface of the spacer with edge metallization such that the edge metallization forms an electrical connection between the spacer and backplate, and sealing the backplate and faceplate together to encase the spacer in an enclosure. The surfaces can be treated by forming a resistive coating or coatings, by surface doping, by surface doping and forming a resistive coating or coatings, or by firing to reduce the surface. The resistive coating or coatings can be formed by chemical vapor deposition, sputtering, or evaporation.

BRIEF DESCRIPTION OF THE DRAWINGS

FIG. 2A is a cross-sectional view taken along line 2B—2B of FIG. 2B, and FIG. 2B is a cross-sectional view taken along line 2A—2A of FIG. 2A.

FIG. 9A is a cross-sectional view taken along line 9B—9B of FIG. 9B, and FIG. 9B is a cross-sectional view taken along line 9A—9A of FIG. 9A.

DETAILED DESCRIPTION OF EMBODIMENTS OF THE INVENTION

In the following description, embodiments of the invention are described with respect to a flat cathode ray tube (CRT) display. It is to be understood that the invention is also applicable to other flat panel displays such as plasma displays or vacuum fluorescent displays. Further, the invention is not limited to use with displays, but can be used with other flat panel devices used for other purposes such as optical signal processing, optical addressing for use in controlling other devices such as, for instance, phased array radar devices, or scanning of an image to be reproduced on another medium such as in copiers or printers. Additionally, the invention is applicable to flat panel devices having non-rectangular screen shapes, e.g., circular, and irregular screen shapes such as might be used in a vehicle dashboard or an aircraft control panel.

Herein, a flat panel display is a display in which the faceplate and backplate are substantially parallel, and the thickness of the display is small compared to the thickness of a conventional deflected-beam CRT display, the thickness of the display being measured in a direction substantially perpendicular to the faceplate and backplate. Typically, though not necessarily, the thickness of a flat panel display is less than 2 inches (5.08 cm). Often, the thickness of a flat panel display is substantially less than 2 inches, e.g., 0.25–1.0 inches (0.64–2.54 cm).

Figure 1:
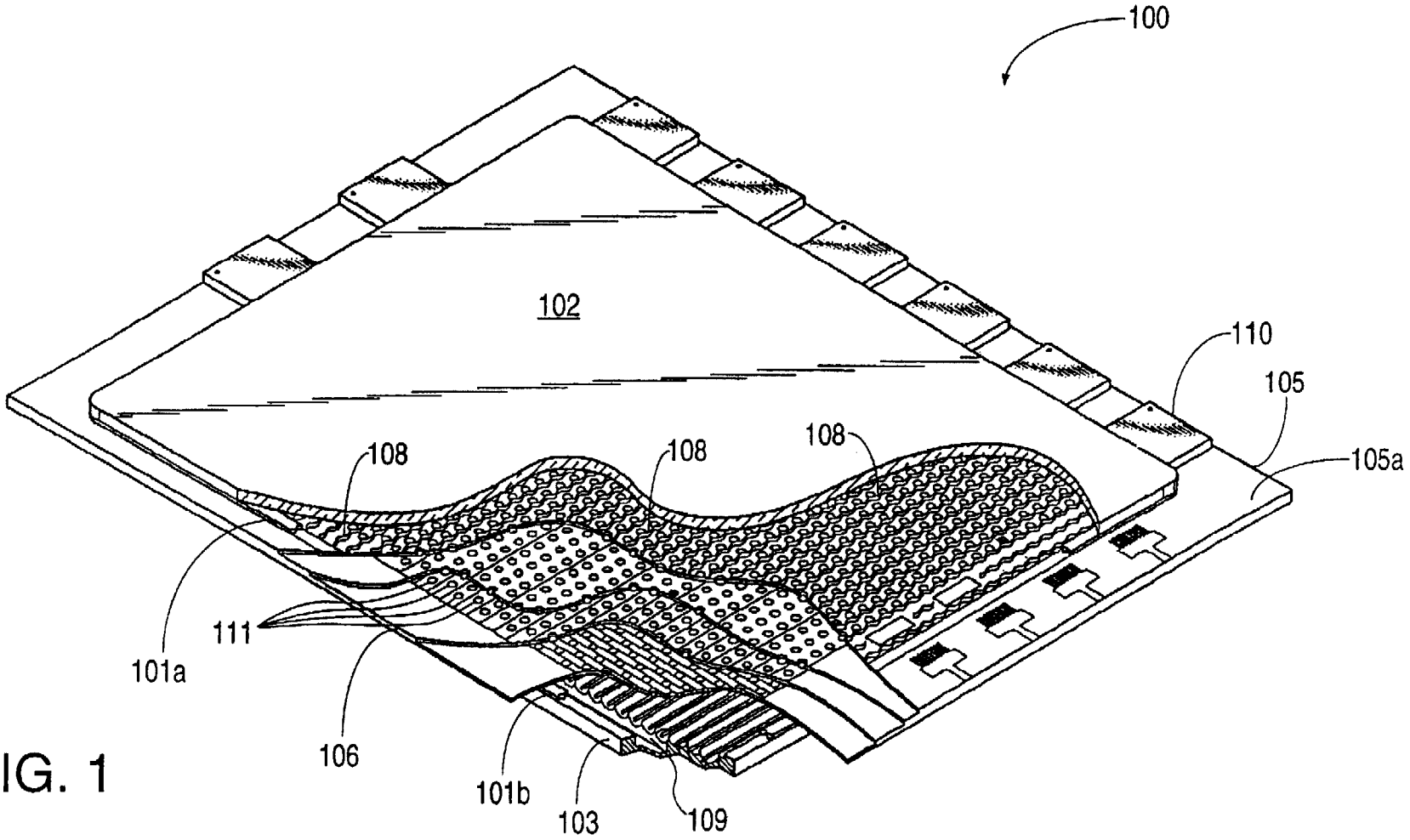
FIG. 1 is a perspective cutaway view of a flat panel display including a thermionic cathode according to an embodiment of the invention.

FIG. 1 is a perspective cutaway view of flat panel display 100 according to an embodiment of the invention. Flat panel display 100 includes faceplate 102, backplate 103 and layer 105 having peripheral region 105*a* outside seals 101*a*, 101*b* on which electronics 110 are disposed. Faceplate 102, backplate 103, layer 105 and seals 101*a*, 101*b* form an enclosure that is held at vacuum pressure (herein, vacuum pressure is defined as any pressure less than atmospheric pressure) of approximately $1\times10^{-7}$ torr. Within the enclosure, cathode 109, which is formed on or near backplate 103, is heated to emit electrons toward the phosphor-coated interior surface of faceplate 102 (i.e., anode). Addressing grid 106 is positioned between cathode 109 and faceplate 102. Electronics 110 includes driving circuitry for controlling the voltage of electrodes in holes 111 of addressing grid 106 so that the flow of electrons to faceplate 102 is regulated. Spacers 108 support faceplate 102 against addressing grid 106.

Figure 2B:
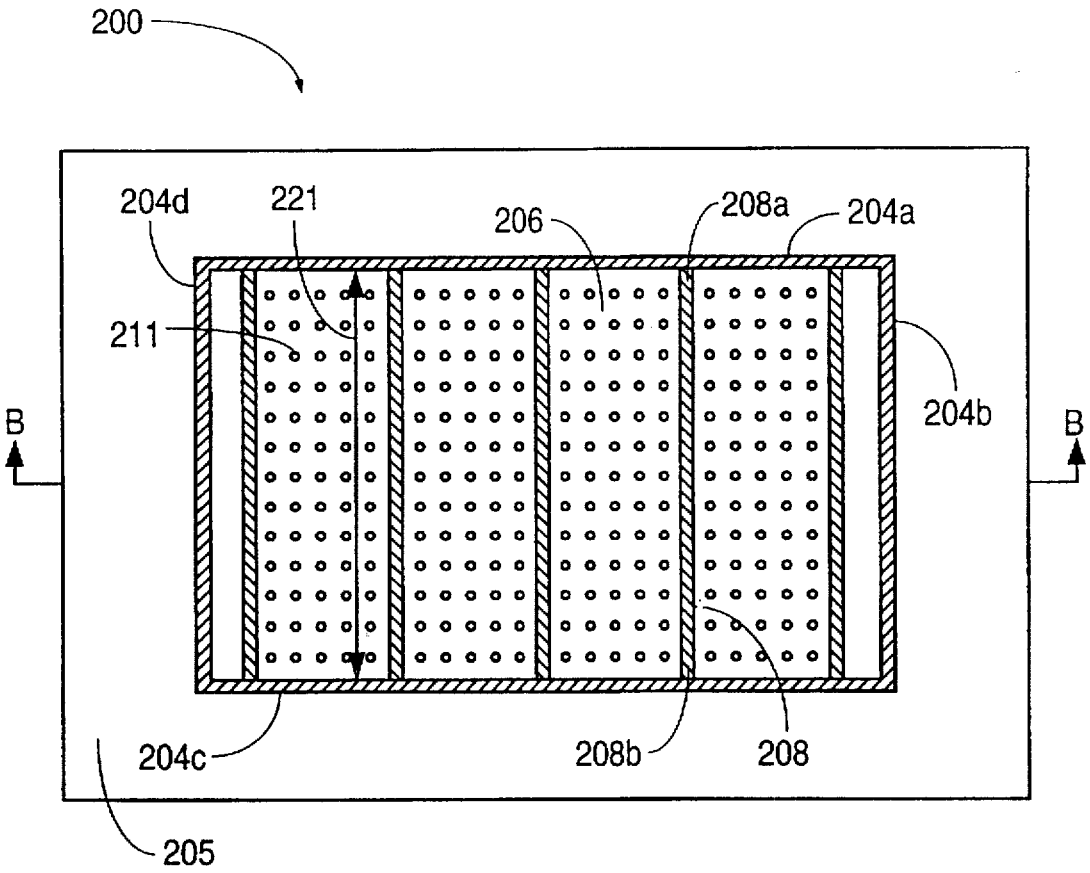
FIGS. 2A and 2B are simplified cross-sectional views of a flat panel display according to an embodiment of the invention illustrating the use of spacer walls.
Figure 2A:
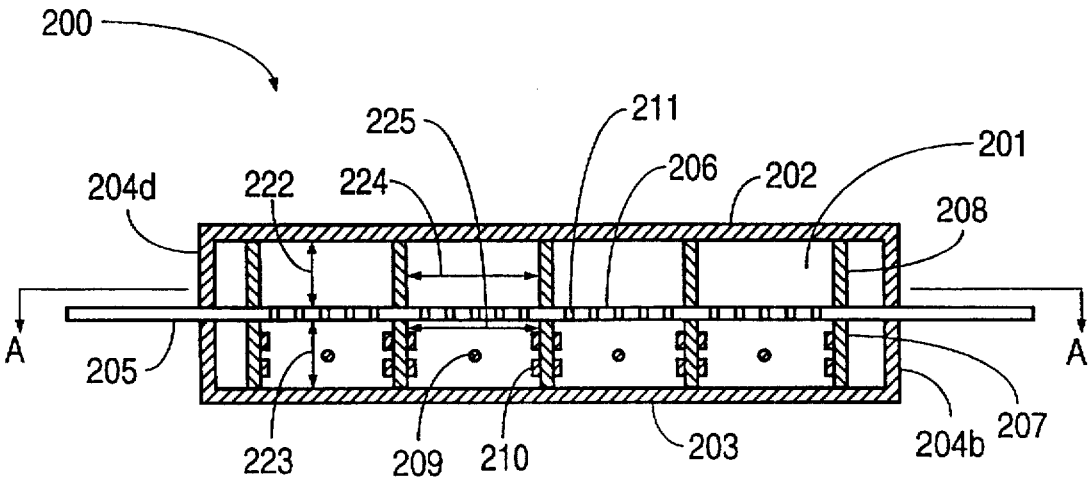

FIG. 2A is a simplified cross-sectional view, taken along line 2B—2B of FIG. 2B, of flat panel display 200 according to the invention. FIG. 2B is a simplified cross-sectional view, taken along line 2A—2A of FIG. 2A, of flat panel display 200. Faceplate 202, backplate 203, top wall 204*a*, bottom wall 204*c*, and side walls 204*b*, 204*d* form enclosure 201 that is held at vacuum pressure. The side (interior surface) of faceplate 202 facing into enclosure 201 is coated with phosphor or phosphor patterns. Layer 205 is disposed between faceplate 202 and backplate 203. Addressing grid 206 is formed within enclosure 201 on the portion of layer 205 corresponding to the active region (i.e., projected area of the phosphor coated region of faceplate 202 on a plane parallel to faceplate 202) of faceplate 202. Spacer walls 207 (cathode spacer walls) and 208 (anode spacer walls) are disposed between backplate 203 and addressing grid 206, and faceplate 202 and addressing grid 206, respectively.

Herein, "spacer" is used to describe generally any structure used as an internal support within a flat panel display. In this disclosure, specific embodiments of spacers according to the invention are described as a "spacer wall" or "spacer walls," or as a "spacer structure." "Spacer" subsumes "spacer wall," "spacer walls," and "spacer structure," as well as any other structure performing the above-described function of a spacer.

A thermionic cathode is located between addressing grid 206 and backplate 203. The thermionic cathode includes cathode wires 209, and directional electrodes 210 formed on cathode spacer walls 207. Though not shown, electrodes could also be formed on backplate 203. Though two directional electrodes 210 are shown formed on each side of each cathode spacer wall 207, it is to be understood that other numbers of directional electrodes 210 could be used. Further, though one cathode wire 209 is shown between each cathode spacer wall 207, it is to be understood that there can be more than one cathode wire 209 between each cathode spacer wall 207.

Each end of each cathode wire 209 is attached to a spring (not shown) by, for instance, welding. The springs are, in turn, attached to backplate 203, addressing grid 206 or cathode spacer walls 207. The springs maintain cathode wires 209 parallel to backplate 203, addressing grid 206 and cathode spacer walls 207 as cathode wires 209 heat and expand during operation of display 200, then cool and contract when display 200 is turned off.

Each cathode wire 209 is heated to release electrons. A voltage is applied to each directional electrode 210 to help shape the electron distribution and electron paths as the electrons move toward addressing grid 206. Voltages applied to electrodes (not shown) formed on the surface of holes 211 formed in addressing grid 206 govern whether the electrons pass through addressing grid 206 to strike the phosphor coated on faceplate 202. Addressing grid 206 may also contain electrodes that direct the electrons to strike a particular phosphor region or regions, and electrodes that focus the electron distribution. As described in more detail below, cathode spacer walls 207 and/or anode spacer walls 208 can be treated to prevent electrostatic charging of spacer walls 207 and/or 208 that can undesirably affect the flow of electrons toward phosphor-coated faceplate 202 and thereby degrade the quality of the image produced by flat panel display 200.

Though a thermionic cathode in which a wire is heated to emit electrons is described above, other types of thermionic cathode can be used. For instance, rather than including a wire, a thermionic cathode (microthermionic cathode) can include dots (the dots can be of any shape) of material formed on backplate 203 which are heated to emit electrons.

Faceplate 202 is made of, for example, glass. Backplate 203 is made of, for example, glass, ceramic, glass-ceramic, silicon or metal. Addressing grid 206 is made of, for example, ceramic or glass-ceramic. Walls 204*a*, 204*b*, 204*c*, 204*d* are made of, for example, glass, ceramic, glass-ceramic or metal.

Illustratively, the thickness of faceplate 202 is approximately 0.080 inches (2.03 mm), the thickness of addressing grid 206 is approximately 0.020 inches (0.51 mm), and the thickness of backplate 203 is approximately 0.080 inches (2.03 mm).

Phosphor or phosphor patterns are coated on the interior surface of faceplate 202. The region of faceplate 202 in which phosphor is coated is called the active region. (Note: "Active region" has been used elsewhere in this description to denote, in addition to the above-described region of faceplate 202, the projected area of that region of faceplate 202 in any plane parallel to faceplate 202.) Phosphor need not cover the entire active region. The phosphor can be segmented into regions. Phosphor regions can be defined by surrounding them with a black border, called a "black matrix," to improve contrast. In order to avoid a "prison cell effect" on the external viewing surface of faceplate 202, anode spacer walls 208 must be located over the black matrix within the active region of faceplate 202 so that anode spacer walls 208 are not seen at the viewing surface of flat panel display 200.

In one embodiment of the invention, the black matrix is raised above the phosphor coating on the interior surface of faceplate 202 by photolithographic patterning and etching away of the black matrix material in the areas to be coated with phosphor. Anode spacer walls 208 contact a part of the black matrix. Since the black matrix is raised above the remainder of faceplate 202, even if anode spacer walls 208 slide from their original position on the black matrix, anode spacer walls 208 are held above the phosphor coating by another part of the black matrix so that the phosphor coating is not damaged by contact with anode spacer walls 208, as is evident from the more detailed description of the black matrix below.

In another embodiment of the invention, the surface of the black matrix is approximately level with the phosphor coating on faceplate 202. Again, anode spacer walls 208 contact the black matrix.

Distance 222 between the phosphor-coated interior surface of faceplate 202 and the facing surface of addressing grid 206 depends upon voltage breakdown requirements. In one embodiment, distance 222 is approximately 0.100 inches (2.54 mm). Distance 223 between the interior surface of backplate 203 and the facing surface of addressing grid 206 depends upon the uniformity of the electron flow from the cathode. In one embodiment, distance 223 is approximately 0.250 inches (6.35 mm).

An important aspect of the invention is that, because of the support provided by spacer walls 207 and 208, the above illustrative dimensions are appropriate for flat panel displays having a diagonal (i.e., the diagonal distance between opposite corners of the active region) of any size.

Spacing 225 of cathode spacer walls 207 is determined according to mechanical and electrical constraints. Mechanically, there must be an adequate number of cathode spacer walls 207, positioned properly with respect to addressing grid 206, to properly support backplate 203 against the pressure differential between the vacuum pressure in enclosure 201 and the atmospheric pressure surrounding the exterior of flat panel display 200. Spacing 225 depends upon distance 223 between the interior surface of backplate 203 and the facing surface of addressing grid 206, the material of which cathode spacer walls 207 are made, and the thickness and material of backplate 203.

Electrically, cathode spacer walls 207 must be located so that directional electrodes 210 are an appropriate distance from each cathode wire 209 to achieve the desired distribution and path-shape of electrons emitted from cathode wires 209, and to ensure that the electrons are accelerated adequately toward addressing grid 206. Depending on the particular electrical and geometrical characteristics of flat display 200, either electrical or mechanical constraints may dictate the maximum allowable spacing 225.

In addition to the above constraints, cathode spacer walls 207 must be located so that they do not cover holes 211 formed in addressing grid 206, or adversely intercept or deflect electrons. However, as noted above and described in greater detail below, cathode spacer walls 207 can be treated to minimize or eliminate undesired interception or deflection of electrons.

Spacing 224 of anode spacer walls 208 is also determined according to mechanical and electrical considerations. Mechanically, there must be an adequate number of anode spacer walls 208, positioned properly with respect to addressing grid 206, to properly support faceplate 202 against the pressure differential between the vacuum pressure in enclosure 201 and the atmospheric pressure surrounding the exterior of flat panel display 200. Similarly to spacing 225, spacing 224 depends upon distance 222 between the interior surface of faceplate 202 and the facing surface of addressing grid 206, the material of which anode spacer walls 208 are made, and the thickness of faceplate 202.

Further, anode spacer walls 208 must be located so that they do not cover holes 211 formed in addressing grid 206, cover phosphor on faceplate 202, or adversely intercept or deflect electrons. Again, however, anode spacer walls 208 can be treated to minimize or eliminate undesired deflection or interception of electrons.

In one embodiment of the invention, for glass faceplate 202 having a thickness of 0.080 inches (2.03 mm), glass-ceramic anode spacer walls 208 having a thickness of 4 mils (0.102 mm), and distance 222 of 0.1 inches (2.54 mm), spacing 224 is approximately 1 inch (2.54 cm). For glass backplate 203 having a thickness of 0.080 inches (2.03 mm), glass-ceramic cathode spacer walls 207 having a thickness of 4 mils (0.102 mm), and distance 223 of 0.25 inches (6.4 mm), spacing 225 is also approximately 1 inch (2.54 cm), taking into consideration only mechanical constraints on spacing 225. However, the maximum spacing 225 of cathode spacer walls 207 may vary from this value because cathode spacer walls 207 can be shaped and because backplate 203 can be made of a material other than glass. Further, as noted above, electrical considerations may dictate a different spacing 225.

Anode spacer walls 208 can be located such that each anode spacer wall 208 is opposite addressing grid 206 from one of cathode spacer walls 207. Anode spacer walls 208 need not be formed opposite each cathode spacer wall 207 if the backplate 203 is sufficiently thick. Further cathode spacer walls 207 need not be formed opposite each anode spacer wall 208.

In the embodiments of the invention discussed so far, cathode spacer walls, e.g., cathode spacer walls 207, have extended all the way from backplate 203 to addressing grid 206. However, this need not be the case for all cathode spacer walls.

In the above description, spacer walls 207 and 208 follow a straight line path between rows of holes 211 in addressing grid 206 from top wall 204*a* to bottom wall 204*c*. In additional embodiments of the invention, spacer walls can follow other than a straight line path through rows of holes 211 in addressing grid 206.

In the above description, spacer walls 207 and 208 extend from close to top wall 204*a* to close to bottom wall 204*c*. Generally, spacer walls 207 and 208 can be formed in any manner to provide support so long as they do not adversely affect the electron flow to faceplate 202. For instance, spacer walls 207 and 208 could be formed that extend from one side wall 204*b* to the other side wall 204*d*, or spacer walls 207 and 208 could extend diagonally across flat panel display 200. Which of these configurations is chosen will depend on the characteristics of the cathode.

Spacer walls 207 and 208 must have a sufficiently small thickness so that spacer walls 207 and 208 do not overlap and block holes 211 in addressing grid 206. In one embodiment of the invention, holes 211 are approximately 5 mils (0.127 mm) in diameter and have a center-to-center distance, measured between holes 211 in the same row or column, of 12.5 mils (0.318 mm). Spacer walls 207 and 208 have a thickness of approximately 4 mils (0.102 mm).

Generally, spacer walls and spacer structures in embodiments of the invention described above and below are made of a thin material which is readily workable in an untreated state and becomes stiff and strong after a prescribed treatment. The material must also be compatible with use in a vacuum environment. Further, the spacer walls and spacer structures are made of a material having a coefficient of thermal expansion that closely matches the coefficients of thermal expansion of the faceplate, backplate and addressing grid (if present). Matching the coefficients of thermal expansion means that the spacer walls, addressing grid, faceplate and backplate expand and contract approximately the same amount during heating and cooling that occurs when the flat panel display is assembled or operated. Consequently, proper alignment is maintained among the spacer walls, addressing grid, faceplate and backplate. Possible consequences of not matching coefficients of thermal expansion are: damage to the phosphor resulting from movement of anode spacer walls or spacer structure relative to the faceplate, stresses within the flat panel display that might cause parts of the flat panel display to fail (including failure of display vacuum integrity), or failure of the anode or cathode spacer walls. Another important aspect of the invention is that the spacer walls and spacer structures can be made of the same material used to form the addressing grid (if present).

In one embodiment, spacer walls 207 and 208 are made of a ceramic or glass-ceramic material. In another embodiment, spacer walls 207 and 208 are formed from ceramic tape. Hereafter, in description of embodiments of the invention, ceramic or glass-ceramic tapes and slurries are the materials used for the spacer walls or spacer structures.

Other materials, such as ceramic reinforced glass, devitrified glass, amorphous glass in a flexible matrix, metal with electrically insulative coating, or high-temperature vacuum-compatible polyimides, could be used. Broadly speaking, the requirements of the material for spacers according to the invention are that (a) it be producible in thin layers, (b) the layers be flexible in the unfired state, (c) holes can be put in a layer or several layers together in the unfired state, (d) the holes can be filled with conductors where desired, (e) conductive traces can be put accurately on the surfaces of the unfired layers, (f) the layers can be laminated, in that they are bonded together at least on a final firing, (g) the fired structure have a coefficient of thermal expansion that can be substantially matched to that of a face plate and a back plate which are made of materials such as float glass, (h) the fired, laminated structure be rigid and strong, (i) the fired structure be vacuum compatible, (j) the fired structure not contain materials which will poison the cathode of the CRT, and (k) all materials and fabrication be possible at practical cost.

In this description and in the claims which follow, the term "ceramic" is often used, in the context of ceramic tape or ceramic layer or ceramic sheet. The term is intended to refer to any of a known family of glass-ceramic tapes, devitrifying glass tapes, ceramic glass tapes, ceramic tapes or other tapes which have plastic binders and ceramic or glass particles and which are flexible and workable in the unfired state, curable to a hard and rigid layer on firing, as well as other materials equivalent thereto, which are initially flexible and may be processed to a final hard and rigid state.

Ceramic tape is formed from a mixture of ceramic particles, amorphous glass particles, binders and plasticizers. Initially, the mixture is a slurry which can be molded instead of formed into ceramic tape. Ceramic tape can be formed from the slurry and, in an unfired state, is a deformable material which can easily be cut and formed as desired. Ceramic tape may be made in thin sheets, e.g., approximately 0.3 to 10 mils. Examples of ceramic tape that can be used with the invention are the tapes available from Coors Electronic Package Co. of Chattanooga, Tennessee as Part Nos. CC-92771/777 and CC-LT20, or tapes that are the substantial equivalent of the Coors ceramic tape.

Another example of a low temperature glass-ceramic material which can be used for the purposes of this invention is du Pont's Green Tape (trademark of du Pont). Green Tape is available in very thin sheets (e.g. about 3 mils to 10 mils) has a relatively low firing temperature, about 900° C. to 1000° C., and includes plasticizers in the unfired state which provide excellent workability. The Green Tape product is a mixture of ceramic particles and amorphous glass, also in particulate form, with binders and plasticizers. See U.S. Pat. Nos. 4,820,661, 4,867,935, and 4,948,759.

Unfired ceramic tape can readily be formed in the ways to be described below to yield spacer walls and spacer structures according to the invention. After forming, the ceramic tape is fired. The firing occurs in two stages: a first stage in which the tape is heated to a temperature of approximately 350° C. to burn out the binders and plasticizers from the tape, and a second stage in which the tape is heated to a temperature (between 800° C. and 2000° C., depending on the composition of the ceramic) at which the ceramic particles sinter together to form a strong, dense structure.

Spacer walls 207 and 208 of FIGS. 2A and 2B are formed and assembled into flat panel display 200 as follows. Strips, having a length and width chosen according to the particular requirements of flat panel display 200, as explained in more detail above, are cut from a sheet of unfired ceramic tape. An advantage of using an unfired ceramic or glass-ceramic is that the strips can be easily fabricated by slitting or die-cutting. The strips are then fired, as described above. The fired strips (spacer walls 207 and 208) are placed at appropriate pre-determined locations with respect to addressing grid 206, faceplate 202 and backplate 203, and attached to addressing grid 206 by, for instance, gluing or glass fritting. During assembly, spacer walls 207 and 208 are held in place so that they are properly aligned with respect to faceplate 202, backplate 203 and addressing grid 206. Proper alignment of spacer walls 207 and 208 can be achieved using, for example, the approach described in more detail below with respect to FIG. 5.

The strips for spacer walls 207 and 208 can also be fabricated by first making and firing sheets of ceramic or glass-ceramic. The fired sheets can then be coated (as explained in more detail below) and cut into strips that form spacer walls 207 and 208. Alternatively, the fired sheets can be cut into strips and then coated.

Figure 3:
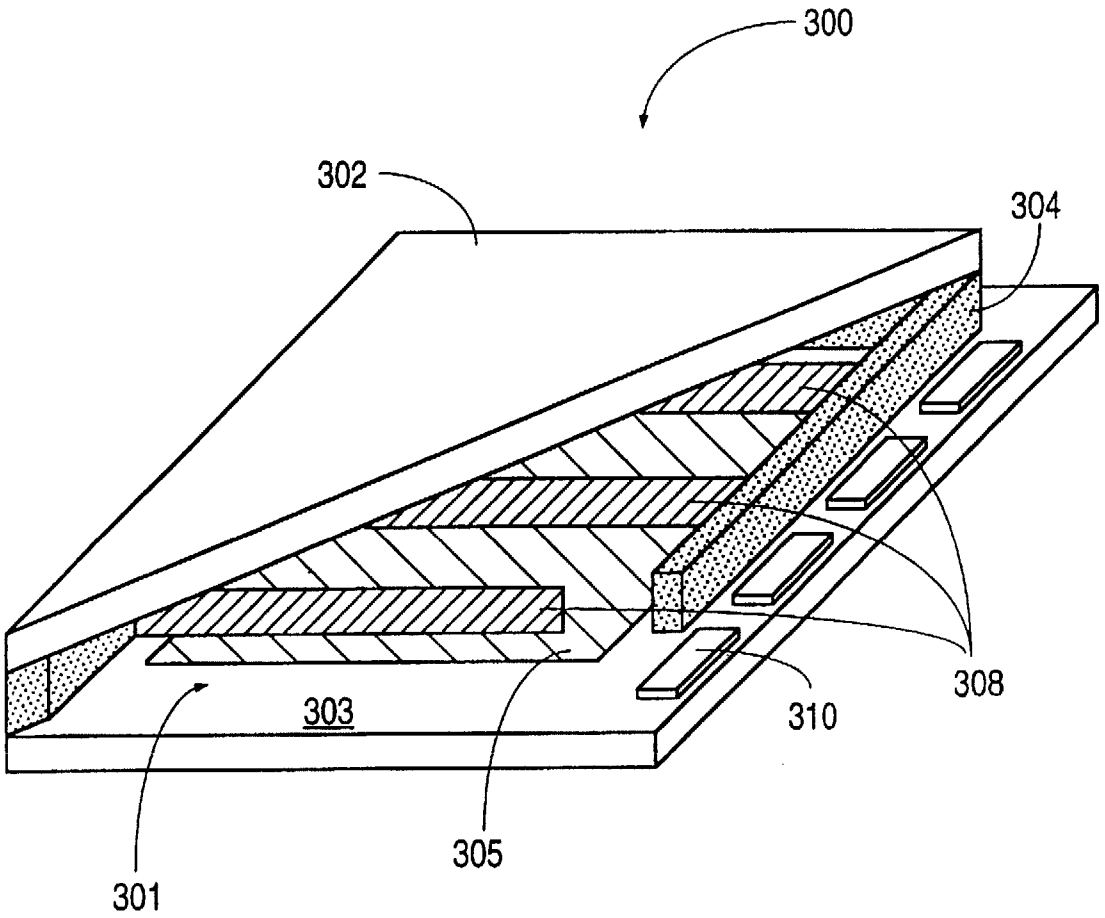
FIG. 3 is a perspective cutaway view of a flat panel display including a field emission cathode according to another embodiment of the invention.

FIG. 3 is a perspective cutaway view of flat panel display 300 according to another embodiment of the invention. Flat panel display 300 includes faceplate 302, backplate 303 and side walls 304 which together form sealed enclosure 301 that is held at vacuum pressure, e.g., approximately $1\times10^{-7}$ torr or less. Spacer walls 308 support faceplate 302 against backplate 303.

Field emitter cathode 305 is formed on a surface of backplate 303 within enclosure 301. As explained in more detail below, row and column electrodes (not shown) control the emission of electrons from a cathodic emission element (not shown). The electrons are accelerated toward the phosphor-coated interior surface of faceplate 302 (i.e., anode), as also explained in more detail below. Integrated circuit chips 310 include driving circuitry for controlling the voltage of the row and column electrodes so that the flow of electrons to faceplate 302 is regulated. Electrically conductive traces (not shown) are used to electrically connect circuitry on chips 310 to the row and column electrodes.

Figure 4:
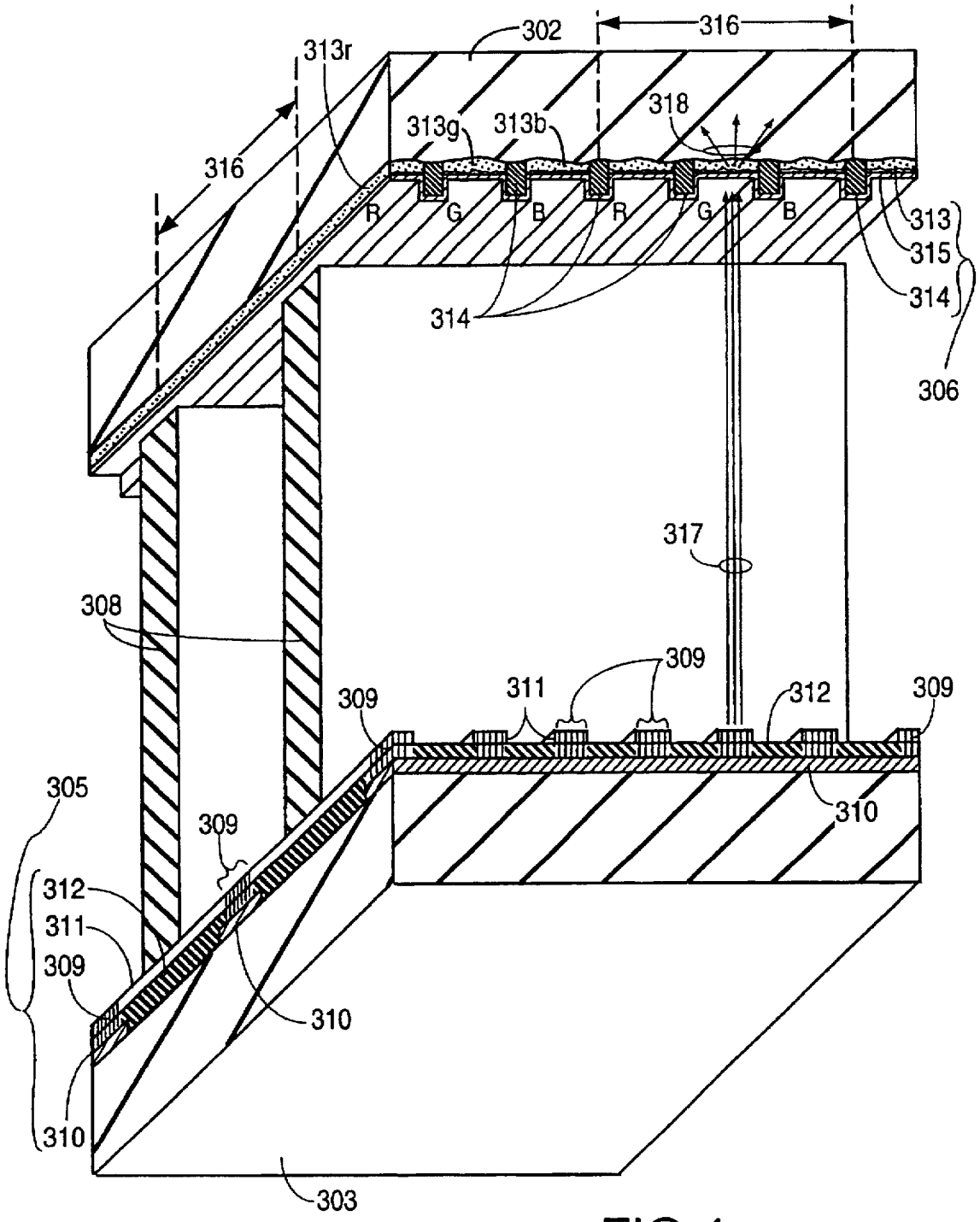
FIG. 4 is a detailed perspective sectional view of a portion of the flat panel display of FIG. 3.

FIG. 4 is a detailed sectional perspective view of a portion of flat panel display 300. Illustratively, the internal surfaces of faceplate 302 and backplate 303 are typically 0.004–0.1 inches (0.1–2.5 mm) apart. Faceplate 302 is glass having, illustratively, a thickness of 0.040 inches (1.0 mm). Backplate 303 is glass, ceramic, or silicon having, illustratively, a thickness of 0.040 inches (1.0 mm). Each spacer wall 308 is made of ceramic having, illustratively, a thickness of 80 to 90 μm. The center-to-center spacing of walls 308 is, illustratively, 8 to 25 mm.

In this embodiment, field emission cathode 305 is a patterned area field emission cathode. It is to be understood that other types of field emission cathodes can be used. Field emission cathode 305 includes a large group of electron-emissive elements (field emitters) 309, a patterned metallic emitter electrode (sometimes referred to as base electrode) divided into a group of substantially identical straight emitter electrode lines 310, a metallic gate electrode divided into a group of substantially identical straight gate electrode lines 311, and an electrically insulating layer 312.

Emitter electrode lines 310 are situated on the interior surface of backplate 303 and extend parallel to one another at a uniform spacing. The center-to-center spacing of emitter electrode lines 310 is typically 315–320 μm. Emitter electrode lines 310 are typically formed of molybdenum or chromium having a thickness of 0.5 μm. Each emitter electrode line 310 typically has a width of 100 μm. Insulating layer 312 lies on emitter electrode lines 310 and on laterally adjoining portions of backplate 303. Insulating layer 312 typically consists of silicon dioxide having a thickness of 1 μm.

Gate electrode lines 311 are situated on insulating layer 312 and extend parallel to one another at a uniform spacing. The center-to-center spacing of gate electrode lines 311 is typically 105–110 μm. Gate electrode lines 311 also extend perpendicular to emitter electrode lines 310. Gate electrode lines 311 are typically formed with a titanium-molybdenum composite having a thickness of 0.02–0.5 μm. Each gate electrode line 311 typically has a width of 30 μm.

Field emitters 309 are distributed in an array above the interior surface of backplate 303. In particular, each group of field emitters 309 is located above the interior surface of backplate 303 in part or all of the projected area where one of gate lines 311 crosses one of emitter lines 310. Spacer walls 308 extend towards areas between field emitters 309 and also between emitter electrode lines 310.

Each group of field emitters 309 extends through an aperture (not shown) in insulating layer 312 to contact an underlying one of emitter electrode lines 310. The tops (or upper end) of each group of field emitters 309 is exposed through a corresponding opening (not shown) in an overlying one of gate electrode lines 311.

Field emitters 309 can have various shapes such as needle-like filaments or cones. Field emitters 309 can be manufactured according to various processes; including those described in U.S. patent application Ser. No. 08/118,490, entitled "Structure and Fabrication of Filamentary Field-Emission Device, Including Self-Aligned Gate", by Macaulay et al., filed Sep. 8, 1993, now U.S. Pat. No. 5,462,467, and U.S. patent application Ser. No. 08/158,102, entitled "Field-Emitter Fabrication Using Charged-Particle Tracks, and Associated Field-Emission Devices", by Spindt et al., filed Nov. 24, 1993, the pertinent disclosures of which are incorporated by reference herein.

A light emitting structure 306 which contains a black matrix is situated between faceplate 302 and spacer walls 308. Light emitting structure 306 consists of a group of light emissive regions 313, e.g., phosphor, that produce light when struck by electrons, a pattern of substantially identical dark, non-reflective ridges 314 that do not produce light when struck by electrons, and a light reflective layer 315. In FIG. 4, light emissive regions 313 are divided into a plurality of substantially identical regions **313*r* that emit red (R) light, a like plurality of substantially identical regions 313*g* that emit green (G) light, and another like plurality of substantially identical regions 313*b*** (B) that emit blue light; however, this need not be the case.

Light reflective layer 315 and, consequently, light emissive regions 313 are maintained at a positive voltage of 1500–10,000 volts relative to the field emitter voltage. When one group of field emitters 309 is suitably excited by appropriately adjusting the voltages of emitter electrode lines 310 and gate electrode lines 311, that group of field emitters 309 emits electrons which are accelerated towards a target light emissive region 313. FIG. 4 illustrates trajectories 317 followed by one such group of electrons. Upon reaching the target light emissive region 313, the emitted electrons cause these phosphors to emit light 318.

Some of the electrons invariably strike parts of the light-emitting structure other than the target phosphors. The black matrix formed by dark ridges 314 compensates for off-target hits in the row direction to provide sharp contrast as well as high color purity.

A light emitting structure containing a black matrix that can be used with the invention is described in more detail in commonly owned, co-pending U.S. patent application Ser. No. 08/188,856, entitled "Structure and Fabrication of Device with Raised Black Matrix for Use in Optical Displays Such as Flat-Panel Cathode-Ray Tubes," by Christopher J. Curtin, et al., filed on Jan. 31, 1994, the pertinent disclosure of which is incorporated by reference herein.

Light reflective layer 315 is situated on light emissive regions 313 and dark ridges 314 as shown in FIG. 4. The thickness of light reflective layer 315 is sufficiently small so that nearly all of the impinging electrons from field emitters 309 pass through light reflective layer 315 with little energy loss. The surface portions of light reflective layer 315 adjoining light emissive regions 313 are quite smooth so that part of the light emitted by light emissive regions 313 is reflected by light reflective layer 315 through faceplate 302. Light reflective layer 315 also acts as the anode for the display. Because light emissive regions 313 contact light reflective layer 315, the anode voltage is impressed on light emissive regions 313.

Spacer walls 308 contact light reflective layer 315 on the anode side of the display. Because dark ridges 314 extend further toward backplate 303 than light emissive regions 313, spacer walls 308 contact portions of layer 315 along the tops (or bottoms in the orientation shown in FIG. 4) of ridges 314. The extra height of ridges 314 prevents walls 308 from contacting and damaging light emissive regions 313.

On the cathode side of the display, spacer walls 308 are shown as contacting gate lines 311 in FIG. 4. Alternatively, walls 308 may contact focusing ridges (described in more detail below with respect to FIGS. 9A and 9B) that extend above lines 311. Spacer walls 308 are manufactured as described in more detail above.

The display is subdivided into an array of rows and columns of picture elements ("pixels"). The boundaries of a typical pixel 316 are indicated by arrows in FIG. 4. Each emitter line 310 is a row electrode for one of the rows of pixels. For ease of illustration, only one pixel row is indicated in FIG. 4 as being situated between a pair of adjacent spacer walls 308 (with a slight, but inconsequential, overlap along the sides of the pixel row). However, two or more pixel rows, typically 24–100 pixel rows, are normally located between each pair of adjacent spacer walls 308.

Figure 5:
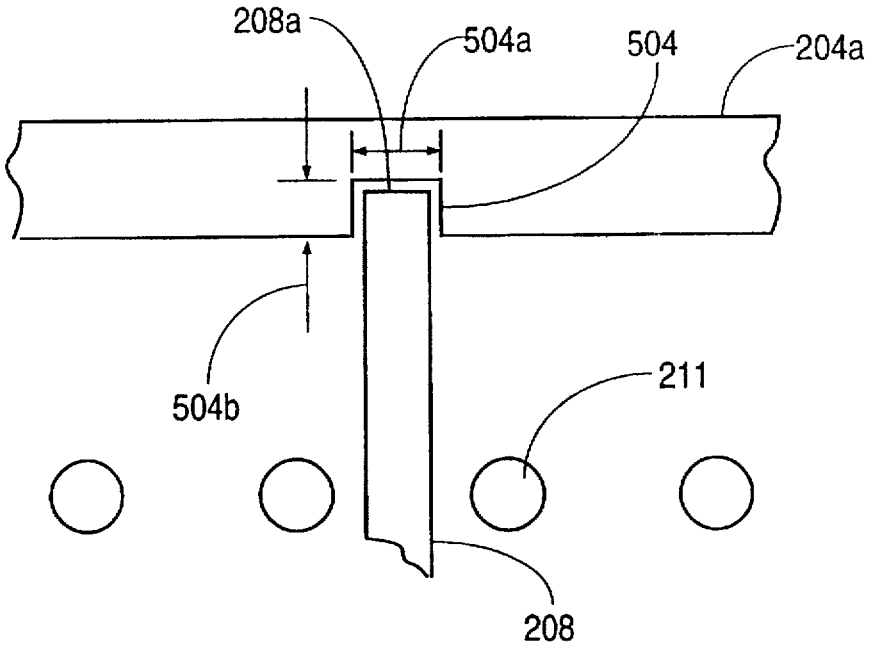
FIG. 5 is a detailed view of a portion of FIG. 2B illustrating means for aligning spacer walls according to an embodiment of the invention.

FIG. 5 is a detailed view of a portion of FIG. 2B illustrating means for aligning spacer walls 207 or 208 according to an embodiment of the invention. Notch 504 is formed, by, for instance, cutting, in a direction perpendicular to the plane of FIG. 5, in top wall 204*a* of flat panel display 200 at a location corresponding to the location of anode spacer wall 208.

During assembly of flat panel display 200, end 208*a* of anode spacer wall 208 is inserted into notch 504 and end 208*b* (FIG. 2B) is inserted into a similar notch formed in bottom wall 204*c* so that anode spacer wall 208 is held in place. Width 504*a* of notch 504 is made slightly larger than the thickness of anode spacer wall 208 so that anode spacer wall 208 is held in place in the direction parallel to top wall 204*a* in the plane of FIG. 5. In one embodiment, the thickness of anode spacer wall 208 is 4 mils (0.102 mm), and width 504*a* is approximately 4.5 mils (0.0114 mm).

Depth 504*b* of notch 504 is made sufficiently large so that, given dimensioning tolerances, anode spacer wall 208 will fit into, and not slip out of, notch 504. Depth 504*b* of notch 504 is, illustratively, approximately 10 mils (0.25 mm). Anode spacer wall 208 is made sufficiently long so that if end 208*a* begins to move out of notch 504, end 208*b* (FIG. 2B) contacts a corresponding notch formed in bottom wall 204*c* before end 208*a* can move completely out of notch 504. Consequently, anode spacer wall 208 is held in place in the direction perpendicular to top wall 204*a*. If, for instance, depth 504*b* is 10 mils (0.25 mm), anode spacer wall 208 is made slightly less than 10 mils (0.25 mm) longer than the distance 221 (FIG. 2A) between top wall 204*a* and bottom wall 204*c* of flat panel display 200.

In an alternative embodiment, rather than cutting notches in the top wall 204*a* and bottom wall 204*c*, respectively, as described above, a notch is formed in addressing grid 206 into which anode spacer wall 208 fits. During assembly of flat panel display 200, anode spacer wall 208 is inserted into the notch in addressing grid 206. The width of the notch is made slightly larger than the thickness of anode spacer wall 208. In one embodiment, the width of the notch is approximately 4.5 mils (0.0114 mm). The depth of the notch is, illustratively, approximately 1–2 mils (0.025–0.051 mm). Anode spacer 208 is made slightly less than 1–2 mils (0.025–0.051 mm) wider than distance 222 between faceplate 202 and addressing grid 206.

In another embodiment, notches are cut, as described above, in each of top wall 204*a*, bottom wall 204*c* and addressing grid 206.

In a further embodiment in which a field emission cathode is used, notches of appropriate size are cut into baseplate 203 into which spacer walls 207 fit.

Though the above description with respect to FIG. 5 is made with respect to end 208*a* of anode spacer walls 208, it is to be understood that end 208*b* (FIG. 2B) is held in place during formation of flat panel display 200 using similar means. Further, cathode spacer walls 207 can be held in place during formation of flat panel display 200 using means similar to that described for anode spacer walls 208. Additionally, if spacer walls 207 and 208 extend between side walls 204*b* and 204*d*, notches are cut in side walls 204*b* and 204*d*, as described above. Finally, though formation of notches for aligning spacer walls according to the invention is described above with respect to flat panel display 200 including a thermionic cathode, it is to be understood that such notches can also be formed in a flat panel display, e.g., flat panel display 300 (FIG. 3), including a field emitter cathode.

Figure 6:
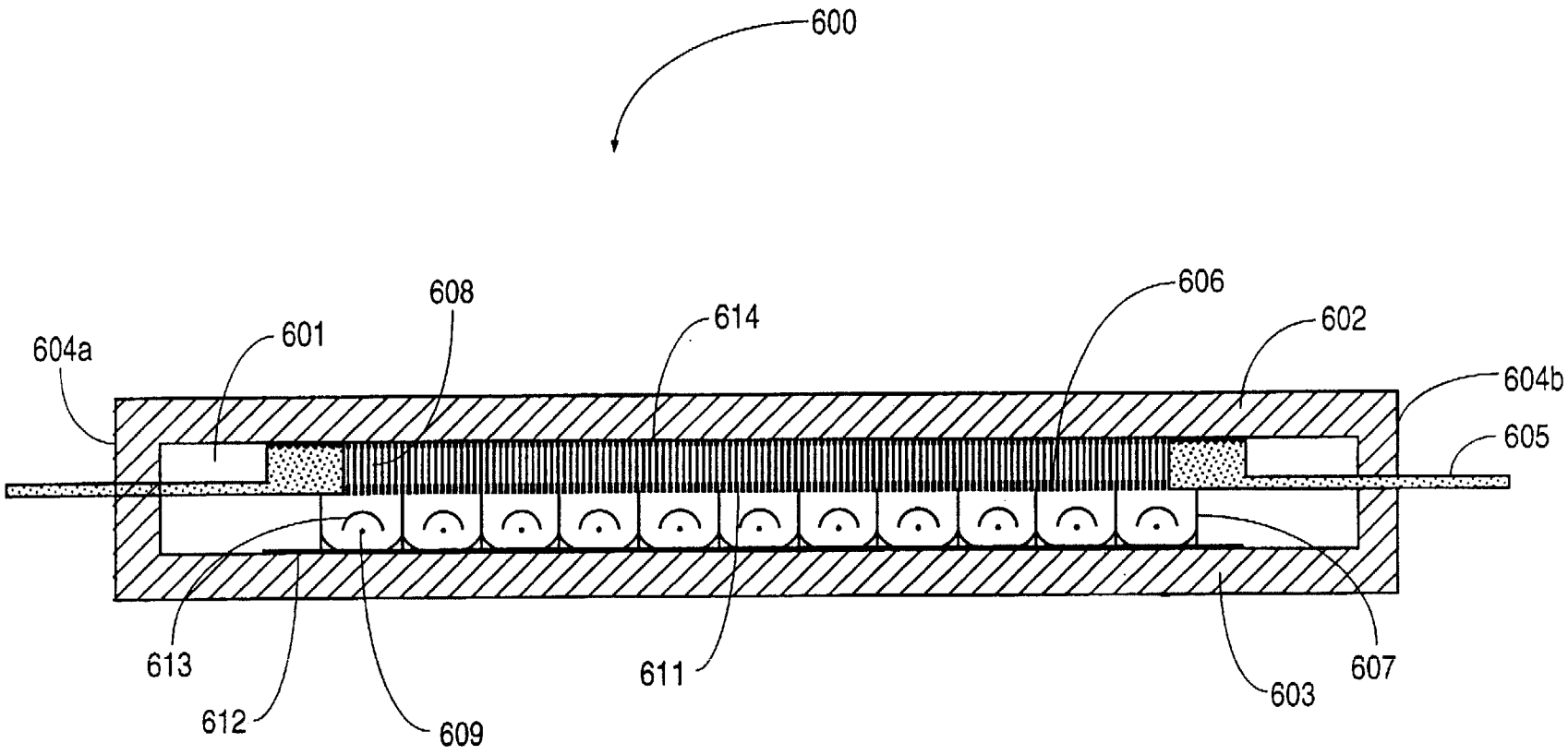
FIG. 6 is a simplified cross-sectional view, viewed in the same direction as FIG. 2A, illustrating a flat panel display including spacer walls and a spacer structure according to another embodiment of the invention.

FIG. 6 is a simplified cross-sectional view, viewed in the same direction as FIG. 2A, illustrating flat panel display 600 including cathode spacer walls 607 and anode spacer structure 608 according to another embodiment of the invention. Faceplate 602, backplate 603, a top wall (not shown), a bottom wall (not shown), and side walls 604*a*, 604*b* form enclosure 601 which is held at vacuum pressure, e.g., approximately $1\times10^{-7}$ torr. The interior side of faceplate 602 is coated with phosphor. Layer 605 is formed between faceplate 602 and backplate 603 within enclosure 601 and extends through a sealed area of the top wall, bottom wall and side walls 604*a*, 604*b* to the outside of enclosure 601. Addressing grid 606 is formed on the portion of layer 605 corresponding to the active region of faceplate 602. Cathode spacer walls 607 and anode spacer structure 608 (referred to as a "grid-to-grid spacer structure") are disposed between backplate 603 and addressing grid 606, and faceplate 602 and addressing grid 606, respectively.

A thermionic cathode is located between addressing grid 606 and backplate 603. The thermionic cathode includes cathode wires 609, backing electrodes 612 and electron steering grids 613. Cathode wire 609 is heated to release electrons. A voltage may be applied to backing electrode 612 to help direct the electrons toward addressing grid 606. Electron steering grid 613 may be used to help extract electrons from cathode wire 609 and distribute the flow of electrons evenly between each cathode spacer wall 607. Voltages applied to electrodes (not shown) formed on the surface of holes 611 formed in addressing grid 606 govern whether the electrons pass through addressing grid 606. Electrons that pass through addressing grid 606 continue through holes 614 in anode spacer structure 608 to strike the phosphor coated on faceplate 602.

In FIG. 6, one cathode wire 609 is shown between each cathode spacer wall 607. It is to be understood that there can be more than one cathode wire 609 between each cathode spacer wall 607.

Cathode spacer walls 607 are formed and assembled into flat panel display 600 as described above for cathode spacer walls 207 of FIGS. 2A and 2B. Anode spacer structure 608 is formed as follows. Several layers of unfired ceramic or glass-ceramic material, e.g., ceramic tape, having the same length and width are laminated together by being held together under pressure and heated to a temperature of approximately 70° C. Holes 614 are formed through the multilayered laminate structure at locations corresponding to holes 611 in addressing grid 606. Holes 614 can be formed in each layer before lamination, in several layers laminated together, or at one time through all of the layers in the multilayer laminate structure. The multilayer laminate structure (anode spacer structure 608) is then fired, either alone or with addressing grid 606, in a two-stage firing, as described above with respect to formation of spacer walls according to the invention, to remove binders and impart stiffness and strength.

Holes 614 can be formed by a number of methods, including, but not limited to, laser drilling, fluid pressure drilling, etching, molding, or mechanical drilling or punching. Addressing grid 606 can be used as a mask for forming holes 614 in anode spacer structure 608 if holes 614 are formed by drilling or etching.

Holes 614 of anode spacer structure 608 can be formed coaxially with holes 611 of addressing grid 606 or holes 614 can be made larger than holes 611 so that each hole 614 encompasses more than one hole 611. In one embodiment, holes 614 are formed coaxially with holes 611 such that the diameter of holes 614 is larger than the diameter of holes 611. The larger diameter holes 614 allow more room for error in aligning holes 611 and 614.

In alternative embodiments, the diameter of holes 614 remains constant throughout the length of holes 614 or the diameter of holes 614 gradually increases along the length of holes 614 in a direction toward faceplate 602. In the latter embodiment, holes 614 may overlap each other adjacent faceplate 602. However, some portion of anode spacer structure 608 must remain between holes 614 to contact faceplate 602 to provide support between addressing grid 606 and faceplate 602.

Cathode spacer walls 607 and anode spacer structure 608 can be made of the same material as addressing grid 606. Using the same material, having the same coefficient of thermal expansion, for cathode spacer walls 607, anode spacer structure 608 and addressing grid 606 means that when cathode spacer walls 607, anode spacer structure 608 and addressing grid 606 are heated during assembly or operation of flat panel display 600, cathode spacer walls 607, anode spacer structure 608 and addressing grid 606 will each expand and contract the same amount so that registry of holes 611 and 614 is maintained and cathode spacer walls 607 do not overlap holes 611. Consequently, cathode spacer walls 607, anode spacer structure 608 and addressing grid 606 are more easily formed, since no compensation for different thermal expansion coefficients must be made in order to maintain registry between holes 611 and 614, and alignment between cathode spacer walls 607 and addressing grid 606 when assembling cathode spacer walls 607, anode spacer structure 608 and addressing grid 606.

In an alternative embodiment, anode spacer structure 608 and addressing grid 606 can be formed at the same time by laminating together all of the layers used to form anode spacer structure 608 and addressing grid 606, then firing the combined structure as described above. Additionally, if anode spacer structure 608 and addressing grid 606 are made of the same material, holes 614 and 611 in anode spacer structure 608 and addressing grid 606, respectively, can be formed at the same time by laminating together all of the layers used to form anode spacer structure 608 and addressing grid 606, then forming holes 614 and 611 using one of the methods described above before firing the combined structure.

If desired, metallization can be formed on some or all of the layers of anode spacer structure 608. Such metallization could be, for instance, electrodes formed on the walls of holes 614 that are used for focusing the electrons or for fixing the voltage at certain locations within holes 614 of spacer structure 608 as the electrons move toward faceplate 602.

Though, in the above description, holes having a circular cross-sectional shape are formed through anode spacer structure 608, holes having other cross-sectional shapes could be formed, e.g., "racetrack," oval, rectangular, diamond, etc.

Figure 7A:
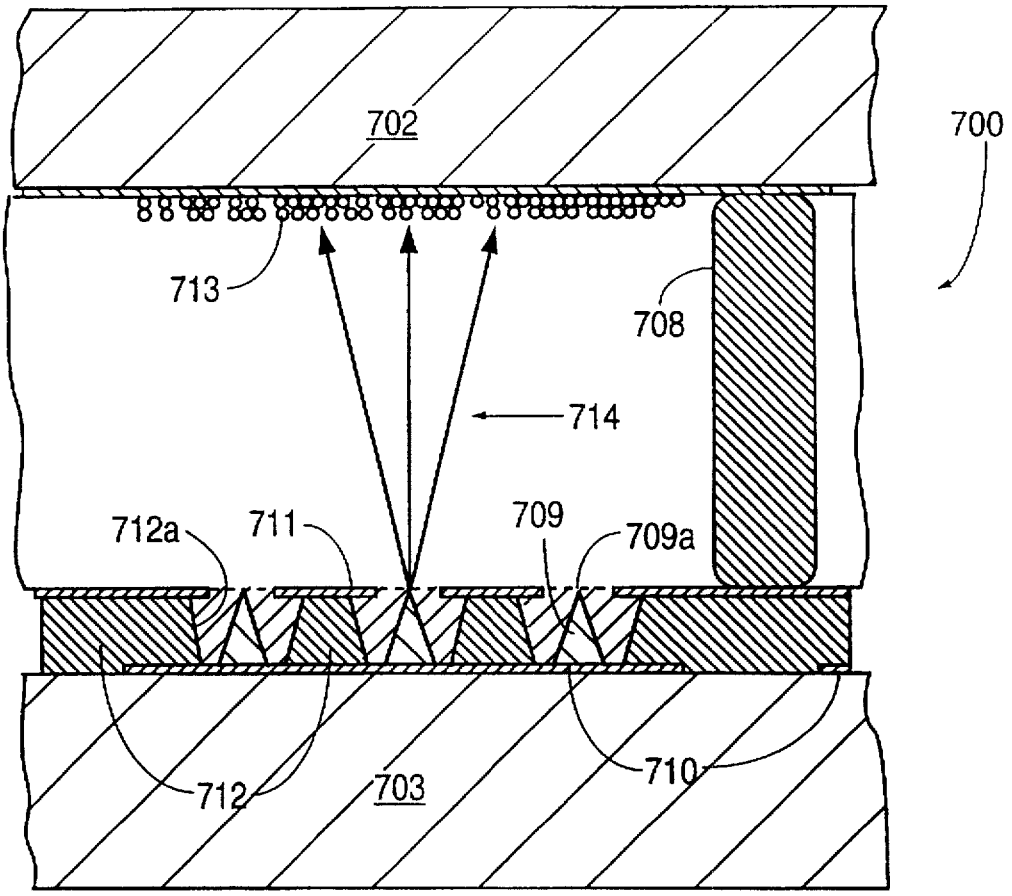
FIG. 7A is a simplified cross-sectional view, viewed in the same direction as FIG. 2A, of a portion of a flat panel display according to an embodiment of the invention including a field emitter cathode and spacer walls.
Figure 7B:
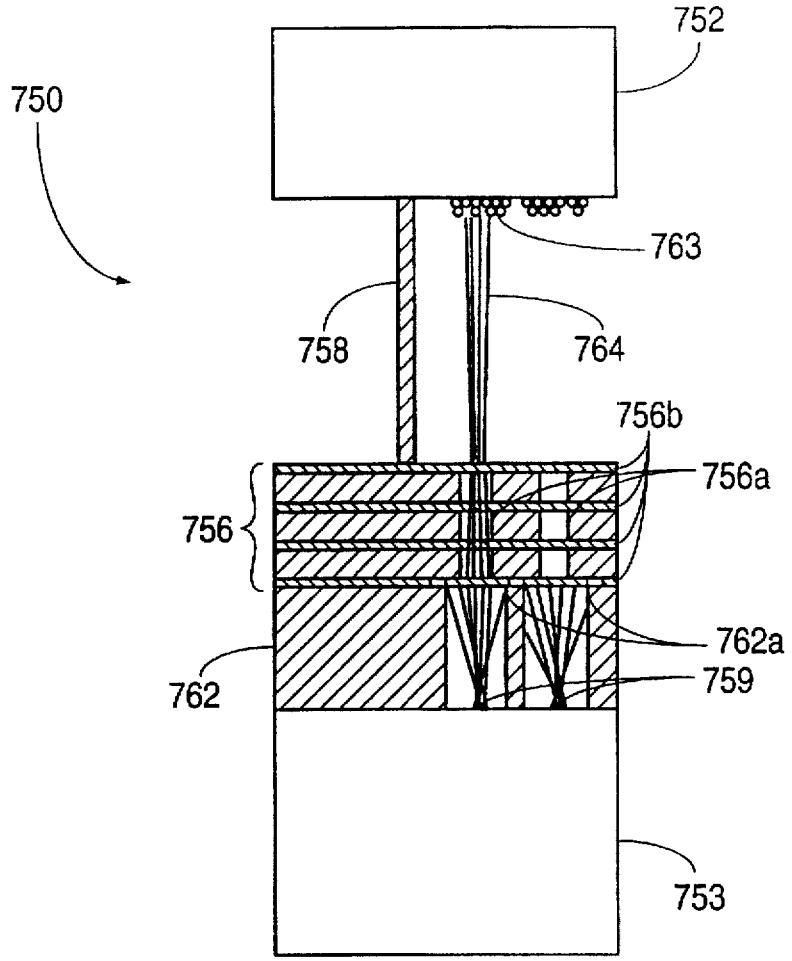
FIG. 7B is a simplified cross-sectional view, viewed in the same direction as FIG. 2A, of a portion of a flat panel display according to another embodiment of the invention including a field emitter cathode, spacer walls and addressing grid.
Figure 7C:
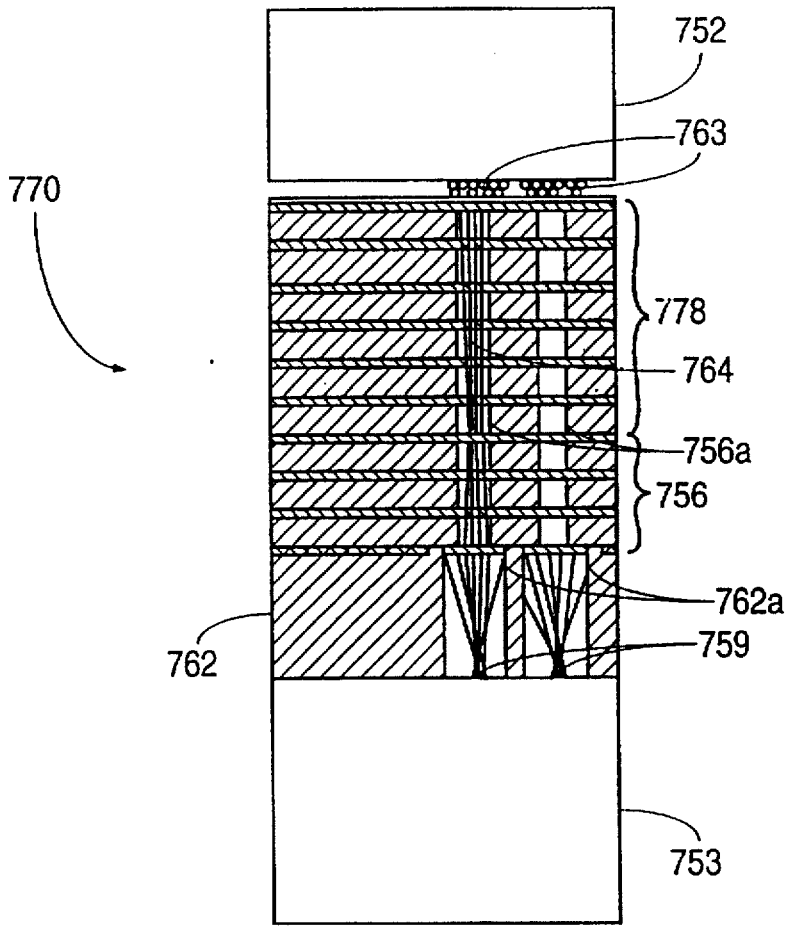
FIG. 7C is a simplified cross-sectional view, viewed in the same direction as FIG. 2A, of a portion of a flat panel display according to another embodiment of the invention including a field emitter cathode, spacer structure and addressing grid.

FIG. 7A is a simplified cross-sectional view, viewed in the same direction as FIG. 2A, of a portion of flat panel display 700 according to an embodiment of the invention, illustrating the use of anode spacer walls 708 in flat panel display 700 including a field emitter cathode (FEC) structure. A particular type of FEC structure is shown in FIG. 7A and a similar FEC structure is shown in FIGS. 7B and 7C below.

The FEC structure includes row electrodes 710 formed on electrically insulative backplate 703. Insulator 712 (made of an electrically insulative material) is formed on backplate 703 to cover row electrodes 710. Holes **712*a* are formed through insulator 712 to row electrodes 710. Emitters 709 are formed on row electrodes 710 within holes 712*a*. Emitters 709 are cone-shaped and tip 709*a* of emitter 709 extends just above the level of insulator 712. It is to be understood that other types of emitters could be used. Column electrodes 711 are formed on insulator 712 around holes 712*a* such that column electrodes 711 extend partially over holes 712*a* to a predetermined distance from emitter tips 709*a***.

An open space separates column electrodes 711 and emitter tips **709*a* from faceplate 702. The open space between the FEC structure and faceplate 702 is sealed and held at vacuum pressure, e.g., approximately $10^{-7}$ torr or less. Phosphor 713 is formed on the surface of faceplate 702 facing the FEC structure. Emitters 709 are excited to release electrons 714 which are accelerated across the open space to strike the phosphor 713 on faceplate 702. When phosphor 713 is struck by electrons 714, phosphor 713 emits light which can be seen through faceplate 702**.

Anode spacer walls 708 extend from the column electrodes 711 to faceplate 702 to support faceplate 702 against the force arising from the differential pressure between the vacuum pressure within flat panel display 700 and the ambient atmospheric pressure outside of flat panel display 700. Anode spacer walls 708 are formed in the same manner as anode spacer walls 208 used with a thermionic cathode, as described above with respect to FIGS. 2A and 2B. Any of the embodiments of anode spacer walls used above with thermionic cathodes can be used with flat panel display 700. Alternatively, an anode spacer structure such as anode spacer structure 608 described above (FIG. 6) can be used with flat panel display 700.

FIG. 7B is a simplified cross-sectional view, viewed in the same direction as FIG. 2A, of a portion of flat panel display 750 according to another embodiment of the invention, illustrating the use of anode spacer walls 758 in flat panel display 750 including a FEC structure and addressing grid 756. The construction and use of an addressing grid with a FEC is described in detail in commonly owned, co-pending U.S. patent application Ser. No. 08/012,297, entitled "Grid Addressed-Field Emission Cathode," by Robert M. Duboc, Jr. and Paul A. Lovoi, filed on Feb. 1, 1993, the disclosure of which is herein incorporated by reference.

Flat panel display 750 includes faceplate 752 and backplate 753 which, together with side walls (not shown), form a sealed enclosure that is held at vacuum pressure. An insulating layer 762 is formed on an interior surface of backplate 753. Emitters 759 are formed on backplate 753 in holes **762*a* formed in insulating layer 762. Addressing grid 756 is disposed on insulating layer 762. Holes 756*a* are formed through addressing grid 756 such that holes 756*a* are coaxial with holes 762*a* of insulating layer 762. Electrical conductors 756*b* are formed in addressing grid 756 and extend to holes 756*a*. Emitters 759 release electrons 764 which are accelerated through holes 762*a* and 756*a*** by application of appropriate voltages to electrical conductors 756*b* to hit phosphor regions 763 formed on an interior surface of faceplate 752.

Anode spacer walls 758 support faceplate 752 against the force arising from the differential pressure between the internal vacuum pressure and the external atmospheric pressure. Anode spacer walls 758 are located so that anode spacer walls 758 do not interfere with the flow of electrons 764. Anode spacer walls 758 are formed as described above. Any of the embodiments of anode spacer walls described above can be used.

Rather than anode spacer walls, an anode spacer structure can be used. FIG. 7C is a simplified cross-sectional view, viewed in the same direction as FIG. 2A, of a portion of flat panel display 770 according to another embodiment of the invention, illustrating the use of anode spacer structure 778 in flat panel display 770 including a field emitter cathode (FEC) structure and addressing grid 756. Flat panel display 770 is similar to flat panel display 750 except that spacer structure 778 is used instead of spacer walls 758. Spacer structure 778 is formed in the same manner as the spacer structures, e.g., spacer structure 608 (FIG. 6), described above. Any of the embodiments or variations of a spacer structure described above can be used.

In embodiments of the invention described above including a thermionic cathode, cathode-spacer walls are used to support the backplate against the addressing grid. As previously noted, a microthermionic cathode in which electrodes are emitted from dots of material formed on the backplate can be used instead of a thermionic cathode in which electrons are emitted from a cathode wire. A microthermionic cathode is structured in a way that is similar to the field emitter cathode structures described above. Consequently, it is possible to use a cathode spacer structure, similar to the anode spacer structure described above, between the backplate and the addressing grid to provide internal support between the backplate and addressing grid of the flat panel display. Such a cathode spacer structure can be used in flat panel displays including either an anode spacer structure or anode spacer walls.

Figure 8:
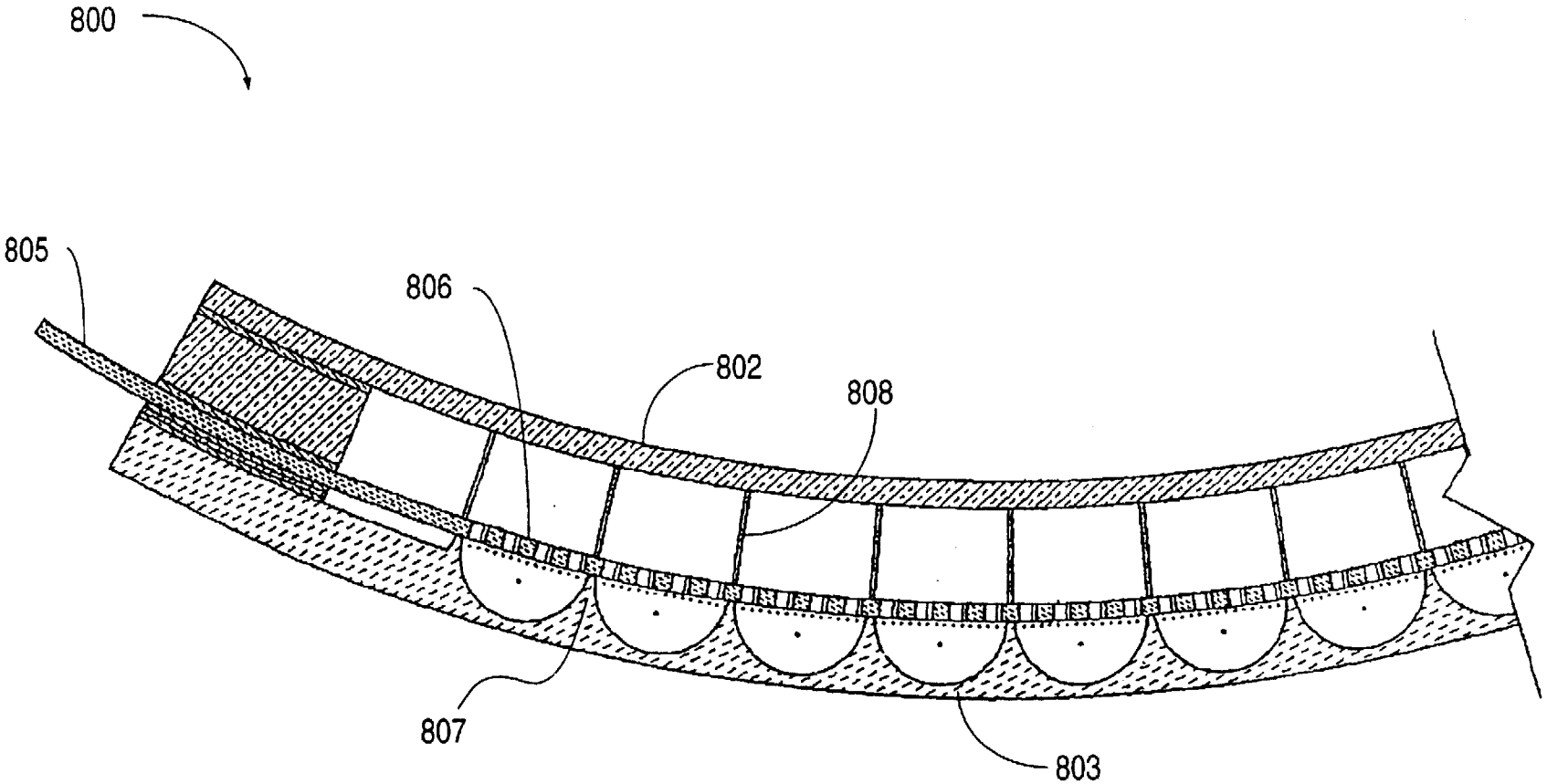
FIG. 8 is a simplified cross-sectional view, viewed in the same direction as FIG. 2A, illustrating the use of spacers according to the invention in a flat panel display having a curved faceplate and backplate.

FIG. 8 is a simplified cross-sectional view, viewed in the same direction as FIG. 2A, illustrating the use of spacer walls 807 and 808 in a curved flat panel display 800 according to the invention. Flat panel display 800 is similar to flat panel display 200, except that faceplate 802, backplate 803 and layer 805 (including addressing grid 806) are each curved so that flat panel display 800 is concave as seen by a viewer. Flat panel display 800 could also be made convex as seen by a viewer.

In each of the above-described embodiments, the spacers must not interfere with the trajectory of the electrons passing between the cathode and the phosphor coating on the faceplate. Thus, the walls of the spacers must be sufficiently electrically conductive so that the spacers do not charge up and attract or repel the electrons to a degree that unacceptably distorts the paths of the electrons. Additionally, the spacers must be sufficiently electrically insulative so that there is no large current flow from the high voltage phosphor resulting in large power losses. Spacers formed from electrically insulative material and coated with a thin electrically conductive material are preferred.

Figure 9A:
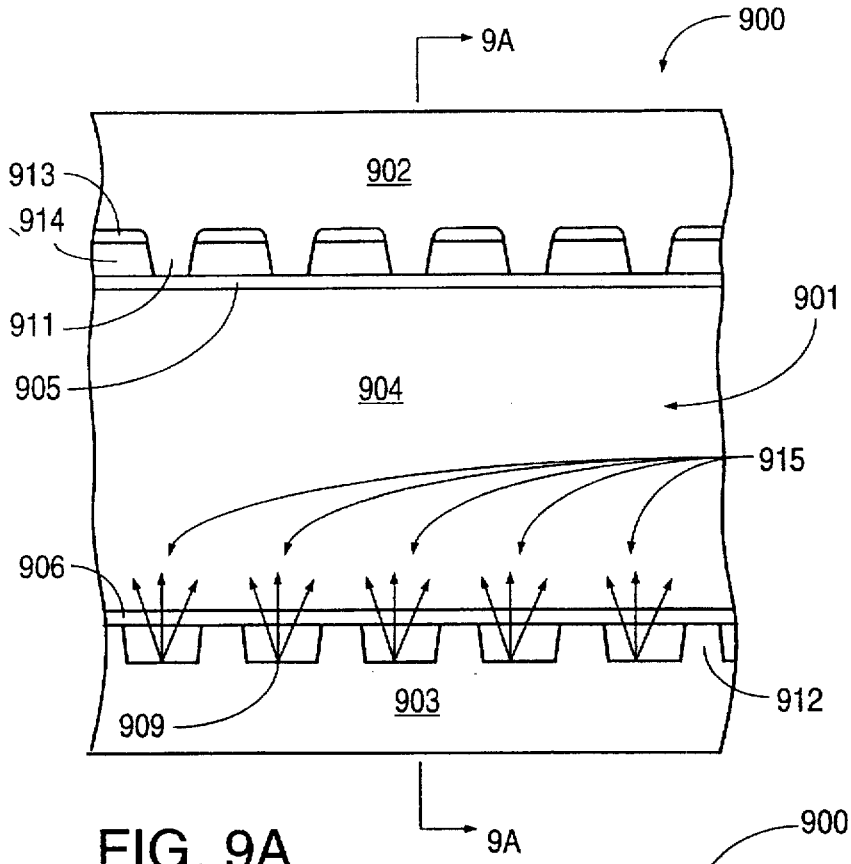
FIGS. 9A and 9B are simplified cross-sectional views of a flat panel display according to an embodiment of the invention illustrating a coating formed on surfaces of the spacer walls.
Figure 9B:
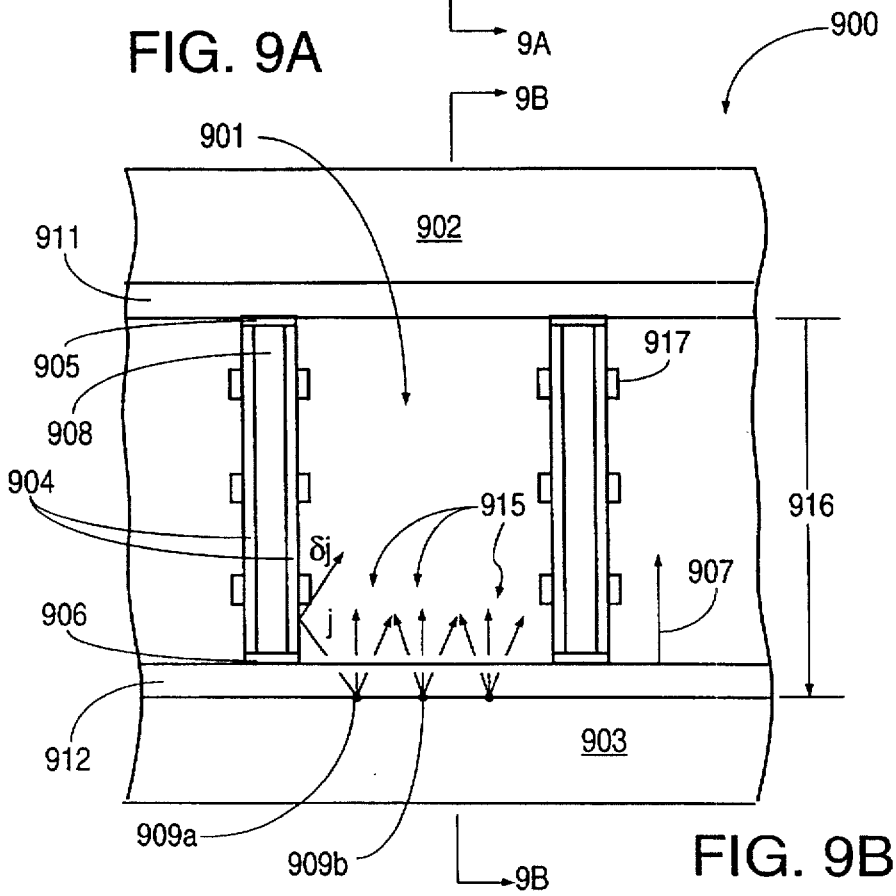

FIG. 9A is a simplified cross-sectional view of a portion of flat panel display 900 including coating 904 formed on spacer walls 908 according to an embodiment of the invention, taken along line 9B—9B of FIG. 9B. FIG. 9B is a simplified cross-sectional view of a portion of flat panel display 900, taken along line 9A—9A of FIG. 9A. Flat panel display 900 includes faceplate 902, backplate 903 and side walls (not shown) which together form sealed enclosure 901 that is held at vacuum pressure, e.g., approximately $1\times10^{-7}$ torr or less.

Focusing ribs (or ridges) 912 are formed adjacent the interior surface of backplate 903 and perpendicular to the plane of FIG. 9A. The use and formation of focusing ribs in a flat panel display is described in more detail in commonly owned, co-filed U.S. patent application Ser. No. 08/188,855 entitled "Field Emitter with Focusing Ridges Situated to Sides of Gate," by Christopher J. Spindt et al., the pertinent disclosure of which is herein incorporated by reference. In the trough formed between each pair of focusing ribs 912, field emitters 909 are formed on an interior surface of backplate 903. Field emitters 909 are formed in groups of approximately 1000. Although not illustrated in FIGS. 9A and 9B, a pattern of emitter-electrode lines analogous to emitter lines 310 in the embodiment of FIG. 4, lie under field emitters 909 above backplate 903. Likewise, a pattern of unshown gate-electrode lines analogous to gate lines 311 in FIG. 4 are situated above field emitters 909.

A matrix of ridges 911 is formed within enclosure 901 on faceplate 902, as described in more detail above with respect to FIG. 4. Phosphor 913 is formed to partially fill each trough between ridges 911. Anode 914, which is a thin electrically conductive material such as aluminum, is formed on phosphor 913.

Spacer walls 908 support faceplate 902 against backplate 903. The surfaces of each spacer wall 908 intermediate the opposing ends are coated with resistive coating 904 or are surface doped, as described in more detail below. Resistive coating 904 prevents or minimizes charge build-up on spacer wall 908 that can distort the flow of electrons 915.

One end of each spacer wall 908 contacts a plurality of ridges 911 and is coated with edge metallization 905. An opposite end of each spacer wall 908 contacts a plurality of focusing ribs 912 and is coated with edge metallization 906. Edge metallizations 905 and 906 can be made of, for instance, aluminum or nickel. Edge metallization 905 and 906 provide good electrical contact between coating 904 and faceplate 902 or focusing ribs 912, respectively, so that the voltage at the ends of spacer walls 904 is well-defined and a uniform ohmic contact is formed. The interface between spacer wall 908, coating 904 and edge metallization 905 can take on a number of configurations, as described in more detail below. Electrodes 917 are formed on the coated (or doped) surfaces of each spacer wall 908, and are used to "segment" the voltage rise from emitters 909 to anode 914.

In another embodiment of the invention, spacer walls 908 are formed without electrodes 917.

Each group of field emitters 909 emit electrons 915 toward the interior surface of faceplate 902. Circuitry (not shown) is formed as part of flat panel display 900, e.g., on integrated circuit chips that can be attached to, for instance, an exterior surface of backplate 903, and used to control the voltage of electrodes 917. Typically, the voltage of each of electrodes 917 is set so that the voltage increases linearly from the voltage level at field emitters 909 to the higher voltage at anode 914. Thus, electrons 915 are accelerated toward faceplate 902 to strike phosphor 913 and cause light to emanate from flat panel display 900.

Figure 9C:
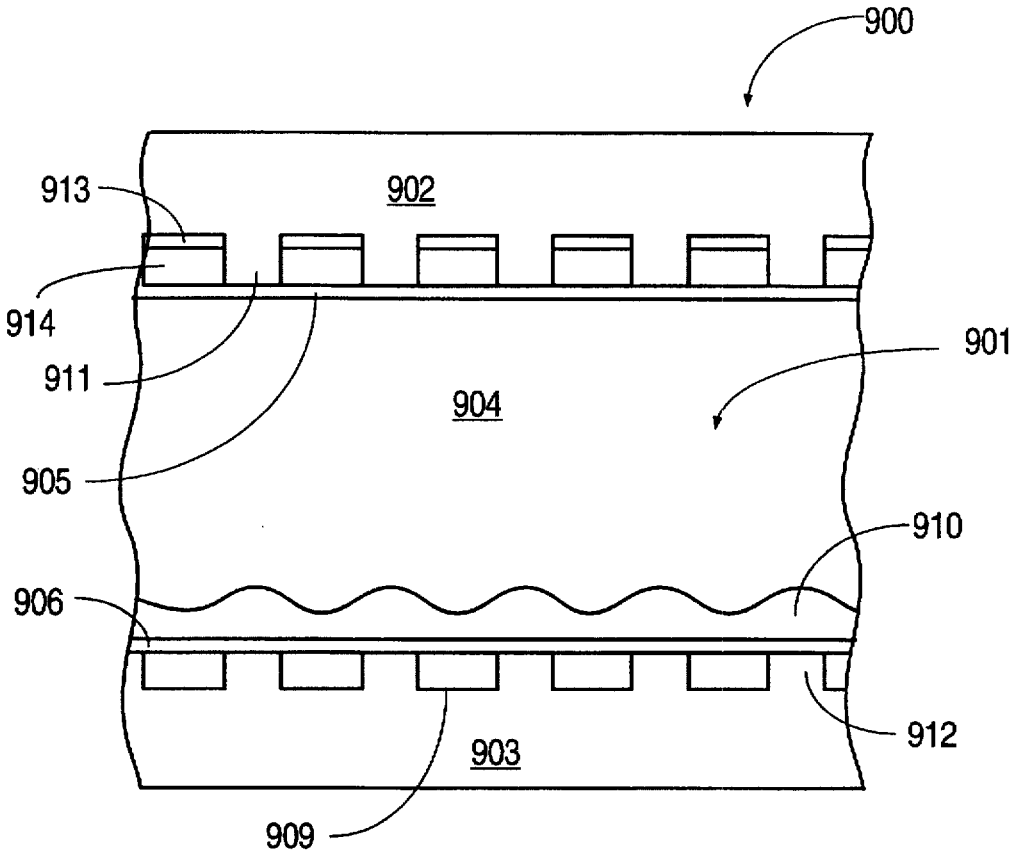
FIG. 9C is a simplified cross sectional view of a flat panel display in accordance with one embodiment of the invention, illustrating an electrode which follows a serpentine path.

For optimum focusing, the desired equipotential lines, in the plane of FIG. 9A, near focusing ribs 912, follow a serpentine path, rising above focusing ribs 912 and falling above the cavity in which emitters 909 are located. However, the presence of spacer wall 909 imposes an equipotential line at this location, i.e., the bottom of spacer wall 908, that is straight. According to the invention, one of electrodes 917 can be located near the bottom of spacer wall 908 and formed in a serpentine path in order to create a potential field having equipotential lines with the desired serpentine shape. An electrode 910 having a serpentine shape as described is illustrated in FIG. 9C.

Figure 10:
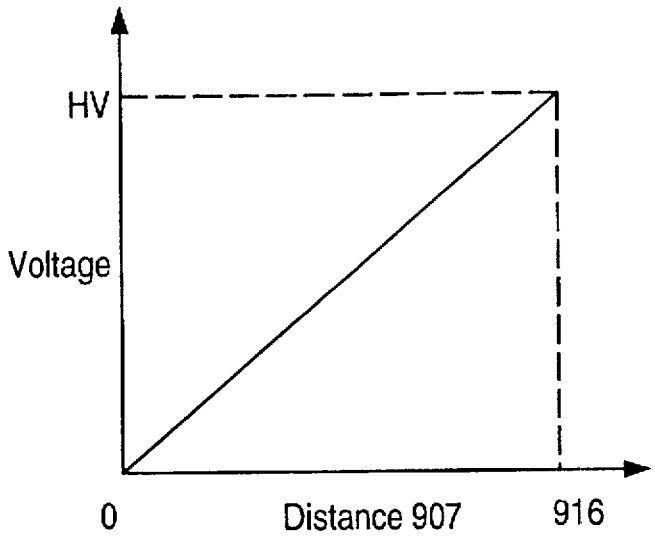
FIG. 10 is a graph of voltage versus distance from a field emitter in a direction perpendicular to a baseplate on which the field emitter is situated.

FIG. 10 is a graph of voltage versus distance 907 (FIG. 9B) from field emitters 909. Anode 914 is spaced apart from field emitters 909 by distance 916, and is held at a higher voltage (designated as HV in FIG. 10) than field emitters 909. For a group of field emitters 909 that are distant from spacer walls 908, e.g., field emitters **909*b*, spacer walls 908 do not interfere with the flow of electrons 915 from field emitters 909 and the voltage change from field emitters 909 to anode 914 is approximately linear as shown in FIG. 10**.

It is necessary that the voltage change near each spacer wall 908 also change linearly between field emitters 909 and anode 914, so that the flow of electrons is not distorted (and the display image thereby degraded). However, for a group of field emitters 909 that are near one of spacer walls 908, e.g., field emitter **909*a*, the adjacent spacer wall 908 can interfere with the flow of electrons 915 from field emitters 909. Stray electrons 915 emitted from field emitters 909*a* will strike spacer wall 908, typically resulting in the accumulation of charge on spacer wall 908. For a given electron density (current density j) striking spacer wall 908, an amount of charge equal to $j\cdot(1-\delta)$ accumulates at the surface of spacer wall 908. For $\delta \not\equiv 1$, the accumulation of charge causes a change in voltage at the surface of spacer wall 908 from the desired voltage, resulting in a non-zero flow of electrons from spacer wall 908. If the conductivity of spacer wall 908 is low, the change in voltage will cause the electron flow near spacer wall 908** to be distorted, resulting in degradation of the image display.

Generally, the deviation of voltage near spacer wall 908 from the desired voltage (based on a linear voltage drop from field emitters 909 to anode 914) is given by the equation:

$$\Delta V=\rho_s\cdot[x\sqrt{(x-d)/2}]\cdot j\cdot(1-\delta) \quad (1)$$

where $\Delta V$=voltage deviation (in volts)

$\rho_s$=sheet resistance of the surface of the spacer wall (in ohms/□)

x=distance from nearest electrode, $0<x<d$ (in cm)

d=distance between electrodes (in cm)

j=current density striking the surface of the spacer wall (in amperes)

$\delta$=secondary emission ratio (dimensionless)

The above equation assumes that current at the current density j strikes spacer wall 908 uniformly and that the sheet resistance $\rho_s$ of spacer wall 908 is uniform. More exactly, equation (1) would account for the dependence of current density j on the position on spacer wall 908, and the dependence of secondary emission ratio $\delta$ on the exact voltage at the position on spacer wall 908.

As can be seen from equation (1), the maximum voltage deviation $\Delta V$ occurs at the midpoint between two electrodes 917 (i.e., the quantity $[x\cdot(x-d)/2]$ is maximized), and is proportional to the distance between the electrodes squared. For this reason, providing additional electrodes 917 minimizes the voltage deviation near spacer wall 908 and, thus, the distortion of the flow of electrons 915 toward faceplate 902. The addition of n electrodes of width w to a spacer wall 908 of height h reduces the power consumption of flat panel display 900 according to the ratio given below:

$$\frac{P_{NEW}}{P_{OLD}}=\frac{d-nw}{d\cdot(n+1)^2} \quad (2)$$

For example, the addition of four electrodes, each electrode being 4 mils wide, to a spacer wall 908 having a height h of 100 mils reduces the $I^2R$ power loss for a given $\Delta V_{max}$ by a factor of approximately 30.

This more efficient charge bleed-off allows a higher value of sheet resistance $\rho_s$ and significant savings in power consumption. Another advantage is that if electrodes 917 protrude slightly, electrodes 917 will intercept much of the charge, preventing the charge from striking the high resistance sections which hold off the voltage. However, each additional electrode 917 increases the manufacturing cost of display 900. The number of electrodes 917 included in flat panel display 900 is chosen as a trade-off between the aforementioned factors.

As further seen in equation (1), for a given number of electrodes 917, the voltage deviation $\Delta V$ also decreases as the sheet resistance $\rho_s$ decreases, and as the secondary emission ratio $\delta$ approaches 1. Thus, it is desirable that the surfaces of spacer walls 908 have a low sheet resistance $\rho_s$ and a secondary emission ratio $\delta$ that approaches 1. Since the secondary emission ratio $\delta$ can only go as low as zero, but can increase to a very high number, the secondary emission ratio requirement is typically stated as a preference for a material having a low value of secondary emission ratio $\delta$.

Figure 11:
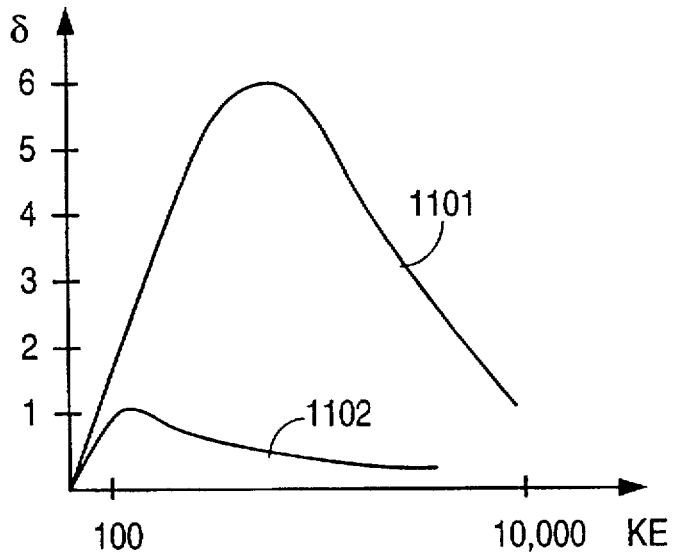
FIG. 11 is a graph of secondary emission ratio versus voltage illustrating the characteristics of two materials.

FIG. 11 is a graph of secondary emission ratio $\delta$ versus voltage illustrating the characteristics of two materials: material 1101 and material 1102. For most high resistivity materials, such as material 1101, the secondary emission ratio $\delta$ is greater than 1 (and frequently much greater) for an energy range between 100 volts to 10,000 volts, resulting in a positively charged surface. Anode 914 is typically maintained at a positive voltage of 1500–10,000 volts relative to emitters 909 as is the case with anode 315 and emitters 309 as described above for FIG. 4. Further, as described above, spacer walls 908 are preferably made of an electrically insulative (i.e., high resistivity) material. Thus, spacer walls 908 are typically positively charged (and frequently highly positively charged), resulting in distortion of the flow of electrons 917 from emitters 909.

However, material 1102 has a secondary emission ratio $\delta$ that, for the voltage range in flat panel display 900, remains near 1. Since the voltage deviation $\Delta V$ varies as the quantity $1-\delta$, when the surfaces of spacer walls 908 are made of material 1102, little charge (positive or negative) accumulates on the surfaces of spacer walls 908. Consequently, the presence of spacer walls 908 has little impact on the voltage drop between field emitters 909 and anode 914, and, therefore, the distortion of the flow of electrons 915 due to the presence of spacer walls 908 is minimized.

According to the invention, the surfaces of spacer walls 908 facing into enclosure 901 are treated with a material having a secondary emission ratio $\delta$ characteristic that looks much like that of material 1102 in FIG. 11. Further, the surface is treated so that the surface resistance will be low relative to the bulk resistivity of spacer wall 908, enabling charge to flow easily from spacer walls 908 to backplate 903 or from faceplate 902, but not so low that there will be high current flow from the high voltage phosphor on faceplate 902 and, thus, large power loss.

In one embodiment of the invention, spacer walls 908 are ceramic and coating 904 is a material having a secondary emission ratio δ less than 4 and a sheet resistance $\rho_s$ between $10^9$ and $10^{14}$ ohms/□. In an additional embodiment, the material used for coating 904 has the above sheet resistance $\rho_s$ and a secondary emission ratio δ less than 2. The coating 904 according to this embodiment is, for instance, chromium oxide, copper oxide, carbon, titanium oxide., vanadium oxide or a mixture of these materials. In a further embodiment, coating 904 is chromium oxide. Coating 904 has a thickness between 0.05 and 20 μm.

In another embodiment of the invention, coating 904 includes a first coating formed on spacer wall 908 of a material having a sheet resistance $\rho_s$ between $10^9$ and $10^{14}$ ohms/□ without regard to the magnitude of the secondary emission ratio δ. The first coating is then covered by a second coating having a secondary emission ratio δ less than 4 in one embodiment, and less than 2 in another embodiment. The material for the first coating is, for instance, titanium-chromium-oxide, silicon carbide or silicon nitride. The material for the second coating is, for instance, chromium oxide, copper oxide, carbon, titanium oxide, vanadium oxide or a mixture of those materials. The total thickness of coating 904 is between 0.05 and 20 μm.

In yet another embodiment of the invention, spacer walls 908 are surface doped to produce a sheet resistance $\rho_s$ between $10^9$ and $10^{14}$ ohms/□, then covered with coating 904 having a secondary emission ratio δ of less than 4 in one embodiment and less than 2 in another embodiment. The dopant can be, for instance, titanium, iron, manganese or chromium. Coating 904 is, for instance, chromium oxide, copper oxide, carbon, titanium oxide or vanadium oxide, a mixture of those materials. In one embodiment, coating 904 is chromium oxide. Coating 904 has a thickness between 0.05 and 20 μm.

In still another embodiment, spacer walls 908 are surface-doped to a concentration to produce a sheet resistance between $10^9$ and $10^{14}$ ohms/□. The dopant can be, for instance, titanium, iron, manganese or chromium.

In another embodiment of the invention, spacer walls 908 are made of a partially electrically conductive ceramic or glass-ceramic material.

The above-described coating 904 can be formed on spacer wall 908 by any suitable method. For example, coating 904 can be formed according to well-known techniques by, for instance, thermal or plasma-enhanced chemical vapor deposition, sputtering, evaporation, screen printing, roll-on, spraying or dipping. Whatever method is used, it is desirable to form coating 904 with a sheet resistance uniformity of ±2%. Typically this is done by controlling the thickness of coating 904 within a specified tolerance.

An alternative to coating spacer surfaces is to take advantage of a material contained in the initial ceramic layers which can be made to become slightly conductive in a later firing.

In the above embodiments, treatment of spacer walls to minimize or eliminate charging of the surfaces of the spacer walls is described. In embodiments of the invention including a spacer structure, e.g., spacer structure 608 (FIG. 6), the surfaces of holes in the spacer structure through which electrons flow are treated, as described above, to minimize or eliminate charging of those surfaces.

FIGS. 12A through 12D are cross-sectional views illustrating the interface between a spacer wall, resistive coating, edge metallization and focusing ribs 1203 according to various embodiments of the invention. The coating in each embodiment can be one of the coatings described above with respect to FIGS. 9A and 9B. In each embodiment, a sharply defined edge metallization/resistive coating interface is formed that is straight and at a constant height above the cathode so that a straight equipotential is defined at the base of the spacer wall along the length of the spacer wall parallel to the backplate. Edge metallization according to the embodiments of the invention described below can be formed on the edge surfaces of the spacer walls by the techniques described above for formation of resistive coating 904.

Figure 12A:
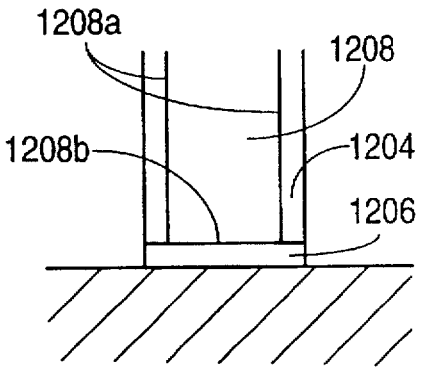
FIGS. 12A through 12D are cross-sectional views illustrating the interface between a spacer wall, edge metallization and focusing ribs according to various embodiments of the invention.

In FIG. 12A, resistive coating 1204 is formed on side surfaces 1208*a* of spacer wall 1208. Coating 1204 is formed on side surfaces 1208*a* so that coating 1204 does not extend beyond the end of side surfaces 1208*a*. Edge metallization 1206 is formed on end surface 1208*b* of spacer wall 1208 so that edge metallization 1206 does not extend beyond coating 1204.

Figure 12B:
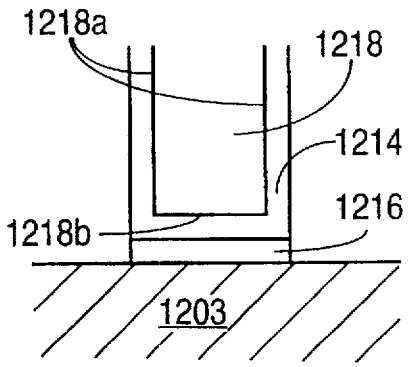

In FIG. 12B, resistive coating 1214 is formed on side surfaces 1218*a* and end surface 1218*b* of spacer wall 1218 to entirely cover spacer wall 1218. Edge metallization 1206 is formed adjacent the portion of coating 1218 formed on end surface 1218*b* of spacer wall 1218 so that edge metallization 1206 does not extend beyond the edge of coating 1204.

Figure 12C:
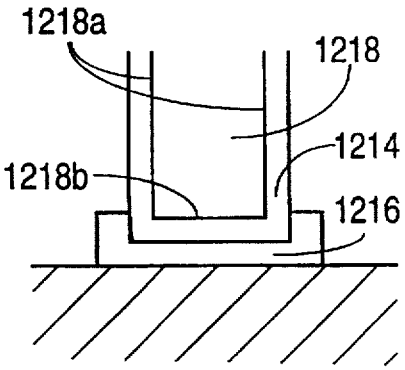

In FIG. 12C, resistive coating 1214 is formed on side surfaces 1218*a* and end surface 1218*b* of spacer wall 1218 to entirely cover spacer wall 1218. Edge metallization 1216 is formed adjacent the portion of coating 1214 formed on end surface 1218*b* of spacer wall 1218 such that metallization 1216 overlaps coating 1214 and extends around the corner of coating 1214 to a well-defined height.

Figure 12D:
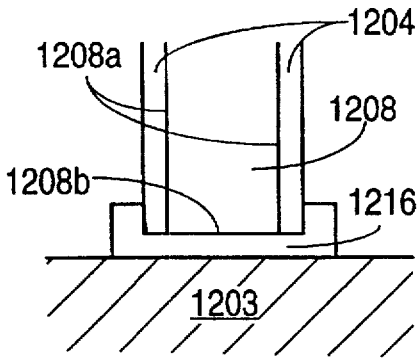

In FIG. 12D, resistive coating 1204 is formed on side surfaces 1208*a* of spacer wall 1208, as in FIG. 12A, so that coating 1204 does not extend beyond the end of side surfaces 1208*a*. Edge metallization 1216 is formed adjacent the portion of coating 1204 formed on end surface 1208*b* of spacer wall 1208 such that metallization 1216 overlaps coating 1204 and extends around the corner of coating 1204 to a well-defined height.

As described above, electrodes 917 are formed at intervals on the surfaces of spacer walls 908 that are exposed within enclosure 901. The voltages at these electrodes 917 are set by a voltage divider. The voltage divider can either be coating 904 or a resistive strip, outside the active region of display 900, connected to electrically conductive traces extending from each of electrodes 917. In order to achieve the desired voltages on each electrode 917, the voltage divider can be "trimmed" by removing material from the voltage divider at selected locations to increase the resistance at those locations as necessary. The trimming can be done by, for instance, using a laser to ablate material from the voltage divider. Alternatively, material can be removed from selected ones of the electrically conductive traces, e.g., the length of one or more of the traces outside of enclosure 901 can be shortened, extending from a voltage divider outside the enclosure to electrodes 917 to achieve the same effect.

Various embodiments of the invention have been described. The descriptions are intended to be illustrative, not limitative. Thus, it will be apparent to one skilled in the art that certain modifications may be made to the invention as described without departing from the scope of the claims set out below.

We claim:

1. A method for fabricating a flat panel device, comprising the steps of:

providing a faceplate structure comprising a faceplate and a light emitting structure;

providing a backplate structure comprising a backplate and an electron emitting structure;

mounting a spacer between the backplate and faceplate structures;

treating surfaces of the spacer to inihibit charge buildup on the spacer surfaces;

coating an edge surface of the spacer with edge metallization such that the edge metallization forms an electrical connection between the spacer and the electron emitting structure of the backplate structure; and sealing the backplate and faceplate structures together to encase the spacer in an enclosure.

2. A method as in claim 1, wherein the step of treating comprises the step of forming a resistive coating over the spacer surfaces.

3. A method as in claim 2, wherein the resistive coating comprises chromium oxide.

4. A method as in claim 2, wherein the resistive coating has a thickness between 0.05 and 20 μm.

5. A method as in claim 2, wherein the resistive coating has a sheet resistance between $10^9$ and $10^{14}$ ohms/□.

6. A method as in claim 5, wherein the step of forming the resistive coating is performed such that the sheet resistance varies no more than ±2 percent throughout the resistive coating.

7. A method as in claim 5, wherein the resistive coating has a secondary emission ratio less than 4.

8. A method as in claim 7, wherein the resistive coating is selected from the group consisting of chromium oxide, copper oxide, carbon, titanium oxide, and vanadium oxide.

9. A method as in claim 5, further comprising the step of forming a second coating over the resistive coating, the second coating having a secondary emission ratio less than 4.

10. A method as in claim 9, wherein the second coating has a thickness between 0.01 and 0.05 μm.

11. A method as in claim 9, wherein the resistive coating is selected from the group consisting of titanium-chromium oxide, silicon carbide and silicon nitride, and the second coating is selected from the group consisting of chromium oxide, copper oxide, carbon, titanium oxide and vanadium oxide.

12. A method as in claim 2, wherein the resistive coating is formed by chemical vapor deposition.

13. A method as in claim 2, wherein the resistive coating is formed by sputtering.

14. A method as in claim 2, wherein the resistive coating is formed by evaporation.

15. A method as in claim 1, wherein the step of treating comprises surface doping the spacer surfaces.

16. A method as in claim 15, wherein the dopant concentration results in spacer surfaces having a sheet resistance between $10^9$ and $10^{14}$ ohms/□.

17. A method as in claim 16, wherein the dopant is selected from the group consisting of titanium, iron, manganese and chromium.

18. A method as in claim 16, further comprising the step of forming a coating over the doped spacer surfaces, the coating having a secondary emission ratio less than 4.

19. A method as in claim 18, wherein the coating is selected from the group consisting of chromium oxide, copper oxide, carbon, titanium oxide and vanadium oxide.

20. A method as in claim 1, further comprising the step of extending portions of the edge metallization partially over side surfaces of the spacer.

21. A method as in claim 1, further comprising the steps of:

forming an electrode on a surface of the spacer near an interface of the spacer and the electron emitting structure; and providing means for controlling the voltage of the electrode to achieve a desired voltage distribution in the vicinity of the interface.

22. A method as in claim 21, wherein the step of forming the electrode comprises the step of patterning the electrode such that the electrode exhibits a serpentine pattern.

23. A method as in claim 1, further comprising the steps of:

forming a plurality of electrodes on a surface of the spacer at intervals; and providing means for controlling the voltage of each electrode to achieve a desired voltage distribution between the electron emitting structure and the light emitting structure.

24. A method as in claim 1, further comprising the step of coating a second edge surface of the spacer with edge metallization such that the second edge metallization forms an electrical connection between the spacer and the light emitting structure.

25. A method as in claim 24, wherein the step of treating comprises forming a resistive coating on the spacer surfaces, and wherein the steps of coating the first and second edge surfaces are performed such that the first and second edge metallizations contact the resistive coating.

26. A method as in claim 1, wherein the step of sealing comprises the step of connecting a plurality of sidewalls between the faceplate structure and the backplate structure.

27. A method as in claim 1, wherein the electron emitting structure comprises a field emitter cathode.

28. A method as in claim 1, wherein the spacer comprises a spacer wall.

29. A method as in claim 1, further comprising the step of forming a plurality of holes through the spacer.

30. A method as in claim 1, further comprising the step of matching the thermal coefficient of expansion of the spacer to the thermal coefficients of expansion of the backplate and the faceplate.

31. A method as in claim 1, wherein the spacer is made of a material selected from the group consisting of ceramic, glass-ceramic material, ceramic reinforced glass, devitrified glass, amorphous glass in a flexible matrix, metal with an electrically insulative coating, and high-temperature vacuum-compatible polyimide.

32. A method for fabricating a flat panel device, comprising the steps of:

providing a faceplate structure comprising a faceplate and a light emitting structure;

providing a backplate structure comprising a backplate and an electron emitting structure;

mounting a spacer wall between the backplate and faceplate structures;

treating surfaces of the spacer wall to inhibit charge buildup on the spacer wall surfaces;

coating an edge surface of the spacer wall with edge metallization such that the edge metallization forms an electrical connection between the spacer wall a selected one of the faceplate and backplate structures; and sealing the faceplate and backplate structures together to encase the spacer wall in an enclosure.

33. A method as in claim 32, wherein the step of treating comprises the step of forming a resistive coating over the spacer wall surfaces.

34. A method as in claim 33, wherein the resistive coating has a sheet resistance between $10^9$ and $10^{14}$ ohms/□.

35. A method as in claim 34, wherein the resistive coating has a secondary emission ratio less than 4.

36. A method as in claim 34, further comprising the step of forming a second coating over the resistive coating, the second coating having a secondary emission ratio less than 4.

37. A method as in claim 32, wherein the step of treating comprises surface doping the spacer wall surfaces.

38. A method as in claim 37, wherein the dopant concentration results in spacer wall surfaces having a sheet resistance between $10^9$ and $10^{14}$ ohms/□.

39. A method as in claim 38, further comprising the step of forming a coating over the doped spacer wall surfaces, the coating having a secondary emission ratio less than 4.

40. A method as in claim 32, further comprising the step of extending portions of the edge metallization partially over side surfaces of the spacer wall.

* * * * *